US010104922B2

(12) United States Patent
Willows et al.

(10) Patent No.: US 10,104,922 B2
(45) Date of Patent: Oct. 23, 2018

(54) TRANSFORMABLE GLOVE

(71) Applicant: Amphipod, Inc., Seattle, WA (US)

(72) Inventors: Keith S. Willows, Seattle, WA (US); June A. Angus, Seattle, WA (US); Antonio Del Rosario, Bellevue, WA (US)

(73) Assignee: AMPHIPOD INC., Seattle, WA (US)

( * ) Notice: Subject to any disclaimer, the term of this patent is extended or adjusted under 35 U.S.C. 154(b) by 135 days.

(21) Appl. No.: 15/251,397

(22) Filed: Aug. 30, 2016

(65) Prior Publication Data

US 2017/0006940 A1 Jan. 12, 2017

Related U.S. Application Data

(63) Continuation of application No. 14/195,168, filed on Mar. 3, 2014, now Pat. No. 9,456,644.

(60) Provisional application No. 61/851,420, filed on Mar. 6, 2013.

(51) Int. Cl.

| | |
|---|---|
| ***A41D 15/00*** | (2006.01) |
| ***A41D 19/00*** | (2006.01) |
| ***A41D 19/01*** | (2006.01) |

(52) U.S. Cl.

CPC ..... *A41D 15/00* (2013.01); *A41D 19/002* (2013.01); *A41D 19/0006* (2013.01); *A41D 19/0017* (2013.01); *A41D 19/01* (2013.01)

(58) Field of Classification Search

CPC ..... A41D 15/00; A41D 15/04; A41D 19/01; A41D 19/002; A41D 19/0006; A41D 19/0017

See application file for complete search history.

(56) References Cited

U.S. PATENT DOCUMENTS

| | | | | |
|---|---|---|---|---|
| 4,651,350 | A * | 3/1987 | Dawiedczyk | A41D 19/0017 2/158 |
| 9,456,644 | B2 * | 10/2016 | Willows | A41D 19/002 |
| 2003/0154536 | A1 * | 8/2003 | Anderson | A41D 3/02 2/108 |
| 2012/0311766 | A1 * | 12/2012 | Clark | A41D 19/01 2/158 |
| 2014/0082825 | A1 * | 3/2014 | Clark | A41D 19/01 2/158 |

* cited by examiner

*Primary Examiner* — Katherine Moran

(74) *Attorney, Agent, or Firm* — Lowe Graham Jones PLLC

(57) ABSTRACT

A transformable glove is formed from multiple panels covering the fingertips, palm, and palm heel of a user. In one version, a back panel is joined to a finger panel, a palm panel, and a palm heel panel along side edges to form a glove, while creating openings allowing fingers to be extended outside the glove as desired. The finger panel combines with the distal end of the back panel to form a finger pocket which can be inverted to allow the fingers to emerge from the glove.

25 Claims, 28 Drawing Sheets

TRANSFORMABLE GLOVE

PRIORITY CLAIM

This application claims the benefit of U.S. patent application Ser. No. 14/195,168, filed Mar. 3, 2014, now U.S. Pat. No. 9,456,644, which in turn claims the benefit of U.S. Provisional Application Ser. No. 61/851,420, filed Mar. 6, 2013, the contents of which are incorporated by reference.

FIELD OF THE INVENTION

The present invention relates to a transformable glove garment that allows a user to wear the glove in a myriad of ways, allowing the user to adjust the glove to their specific and varied use needs from one moment to the next.

BACKGROUND OF THE INVENTION

When engaging in sports like running, biking, and many outdoor activities or the like the conditions change from one moment to the next. During outdoor activities it may be cold in the morning and warmer during the day. During exercise a person may start out cold and then end up hot then get cold again.

There are a variety of products available to cover the hands to protect them against the cold in different situations. For example, mittens cover the hand in a form that includes a thumb pocket and a separate pocket for four fingers, while gloves provide separate pockets for each finger. In some situations it is useful to have the fingertips exposed, and there are gloves that have openings at the ends of the finger pockets for this purpose. Currently, there are no suitable hand-covering garments that are configurable for use in different situations.

SUMMARY OF THE INVENTION

This invention relates to a transformable glove that functions in many ways and has many advantages over gloves, sleeves and mittens that exist today. In preferred versions, the transformable glove garment addresses the need for warmth and protection of different kinds as the conditions change and as a user desires different levels of protection from the elements or the like, the disclosed invention addresses these changing desires and needs.

In some versions, the transformable glove can be integrated into clothing like sweat-shirts, warm-up jackets or the like such that the sleeves have one or more of the preferred transformable features integrated at the sleeve ends.

The transformable glove can be used by athletes or others in competition, recreation or anywhere/anytime hand protection/warmth and or protection from the elements or the like is desired. The transformable glove offers a desirable solution in a comfortable, convenient and ergonomic and readily manufacturable manner.

One preferred version of the transformable glove is not handed, or is symmetrical so that it will work equally well on either hand. Although the disclosed invention can be manufactured one for each hand/arm (having a right and a left which are different for each hand/arm), the preferred novel geometry and construction allows for a single transformable glove to work well for both the right and left hand. This novel disclosed un-handedness geometry is preferable in most cases but in some cases left and right separate handing/handedness may be desirable in some specific situations. This novel disclosed geometry and construction that allows the disclosed invention to work equally well on either hand and not have a right and left hand version has many desirable benefits. Some of these benefits include: easier/less expensive to manufacture, has many user benefits associated with items that do not require the user to figure out what hand the item is for, if one is lost, the lost one can be replaced easily and does not require specifying whether the item is left or right handed.

One version preferably has an integrated pocket. In other versions there are no pockets or there are multiple pockets. The pocket is preferably integrated as disclosed on the back side of the transformable glove garment but it could be also integrated in other areas (although in most cases less preferable) like on the palm area, cuff area hand flap-over area or other locations.

The preferable pocket can be used to store a credit card, race timing chip, RFID chip/card or the like, or other card, money, keys or other small items or the like. The RFID chip/card stored in the preferable pocket is especially useful because the user can leave the card in the pocket and place the back of their hand to the scanner to read the card. Also small personal hand warmers (there are many kinds available for warming hands and feet) can be placed in the pockets and thus the inherent warmth of the transformable glove can be enhanced in this way. When small personal hand warmers are placed in a pocket the preferable novel geometry of the transformable glove allows the glove to be moved/twisted or otherwise adjusted such that the warmers are positioned on the back of the hand, in the palm, on the wrist front/back, etc., such that the warmer can be moved as the user desires.

The pocket can also be configured with a clear and/or translucent or selectively translucent window such than a light or safety flasher or the like can be placed in the pocket to provide illumination. Also in some cases if desirable a light(s), light strip, safety flasher or the like could be integrate in the area of the disclosed preferable pocket and the pocket could provide optional access to the battery and/or electronics for this item or items (as well as function as a pocket for holding other small items).

The transformable glove described and examples of embodiments shown in figures included is believed to offer many benefits over existing items on the market. A confluence of disclosed geometry, construction, materials and features provide for a more comfortably worn, versatile, intuitive, manufacturable transformable glove garment.

A preferred version of the transformable glove provides benefits in the ease of manufacturing. It can be constructed using inexpensive and easily obtained materials, assembled using conventional manufacturing equipment, produced easily and inexpensively as well as with light and comfortable readily available materials giving an aesthetically pleasing highly functional, versatile solution for its desired purpose. Because the preferred transformable glove fits equally well on both hands, one item can be manufactured for both hands, therefore two of the same item sold as sets could be sold instead of a left and a right as is the case of traditional sport gloves. Manufacturing two of the same thing versus a right and a left is in most cases more desirable for manufacturing. Although the disclosed invention is preferably not handed left and, in some cases (although less desirable in most cases) the invention could be made in a left and right handed version.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

The preferred versions of the transformable glove are described below, together with reference to the accompanying figures.

Figure 1:
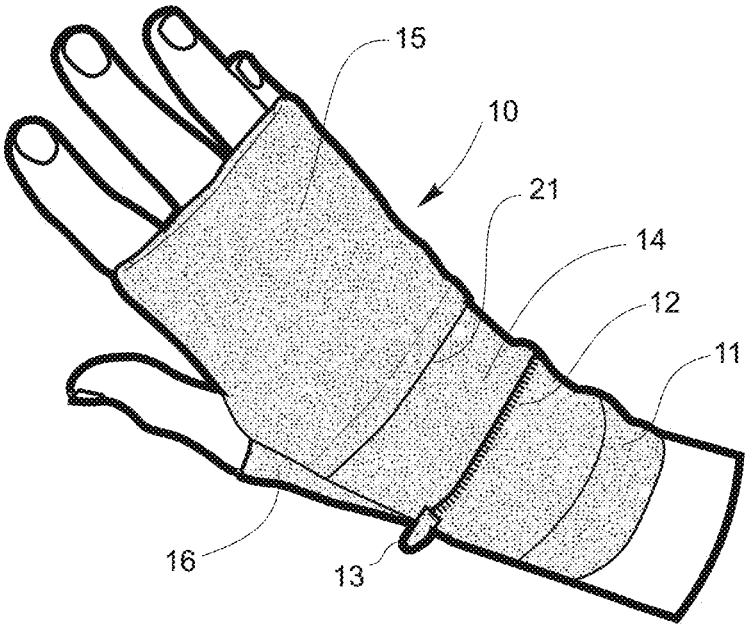
FIG. 1 is a perspective view of a right hand wearing a transformable glove in accordance with the disclosed invention. The fingers/thumb cover is stowed.

FIGS. 1 through 10 illustrate various use modes of transformable glove 10, such that the versatility and transformability is demonstrated. In FIG. 1 a version of a transformable glove 10 (hereafter simply called glove 10) is shown in a back perspective view worn on a user's right hand. Glove 10 has various features in this view, including a cuff 11, a pocket closure 12, a closure pull 13, a back panel 14, a finger/thumb cover panel 15 having a cover panel edge 21, and a palm heel panel 16. Glove 10 is preferably constructed from a number of panels of fabric joined by sewing, gluing, woven/formed integrally together, and/or other methods used in the industry to manufacture garments of this sort to form the preferable glove shown.

The pocket closure 12 is preferably a zipper or the like with the closure pull 13 preferably being a zipper pull, as is depicted in the drawings. In other versions the pocket closure may be attained in many other ways such as with Velcro, buttons, snaps, overlapping edges, and other manners used in industry.

Figure 2:
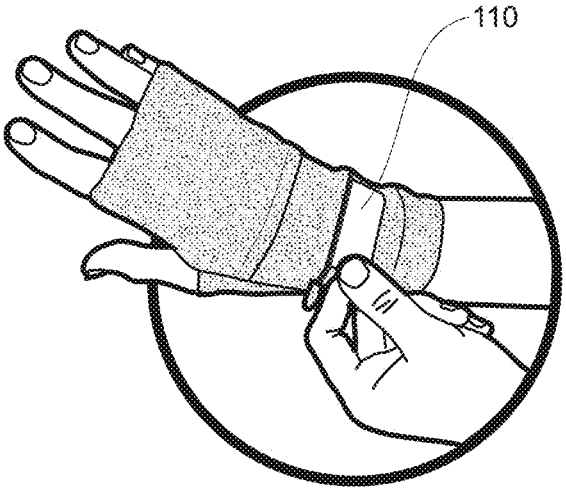
FIG. 2 is a perspective view of the transformable glove showing a credit card or the like being placed inside preferable zipper pocket on back of glove.

FIG. 2 shows a user placing (or removing) a credit card 110 or the like item into a preferable pocket that is formed/constructed in back panel 14. As disclosed previously, although the glove 10 preferably has an integrated pocket, in some cases it could be desirable to eliminate the pocked or integrate more than one pocket or other features integrated/constructed in and/or on the back panel 14 further disclosed herein.

Figure 3:
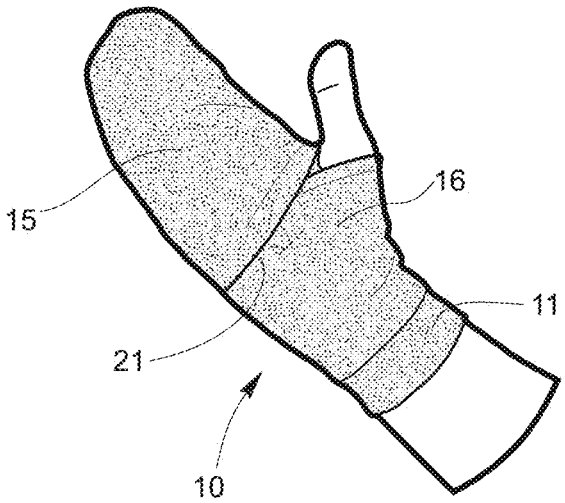
FIG. 3 is a perspective view of the transformable glove wherein a user has deployed the finger/thumb cover over fingers, thumb being still accessible.

FIG. 3 shows the glove 10 with the finger/thumb cover panel edge 21 inverted over user's hand such that finger/thumb cover panel 15 is inverted from the orientation of FIG. 1 and is covering the user's fingers. Thus, in order to reconfigure the glove 10 from the position of FIG. 1 to the position of FIG. 3, the panel edge 21 is grasped from the position of FIG. 1 and pulled toward and over the fingertips, then pulled back downward over the palm side of the hand so that the finger/thumb cover panel 15 surrounds the fingers instead of lying over the back of the hand, and the panel edge 21 is positioned at the palm of the hand instead of the back of the hand.

Figure 4:
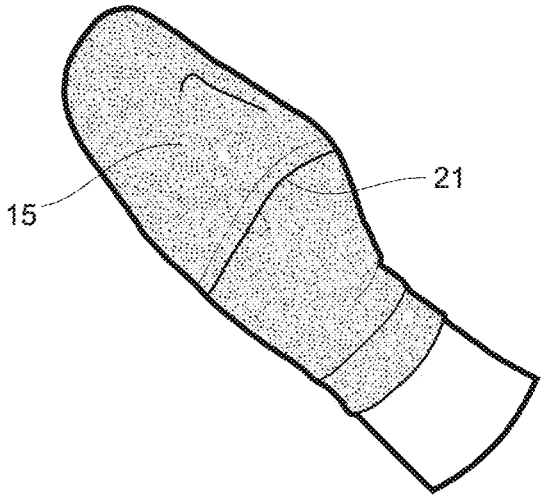
FIG. 4 is a perspective view of the transformable glove wherein a user has deployed the finger/thumb cover over fingers and thumb.
Figure 5:
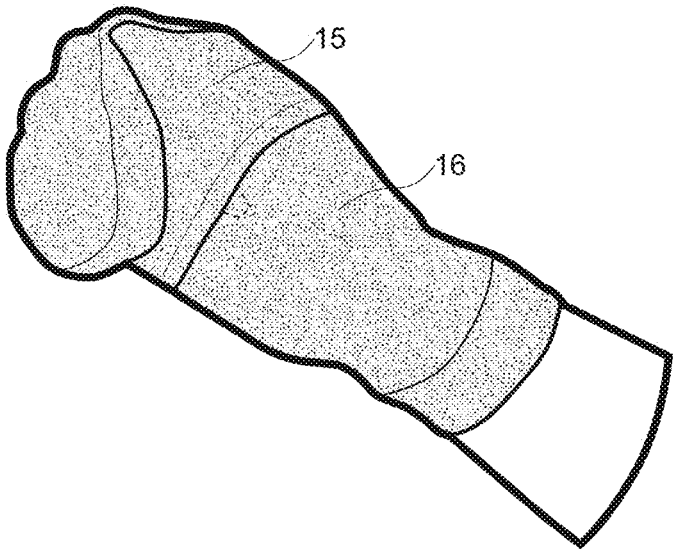
FIG. 5 is a perspective view of the transformable glove wherein a user has deployed the finger/thumb cover over fingers and thumb and hand is shown in fist position.

FIG. 4 shows user's thumb placed under the finger/thumb cover panel 15. Thus, in the illustrated version the finger/thumb cover panel is sufficiently long (terminating at the panel edge 21) such that it can overlap the thumb opening in the palm heel panel 16. FIG. 5 is the same as FIG. 4 but user has made a fist.

Figure 6:
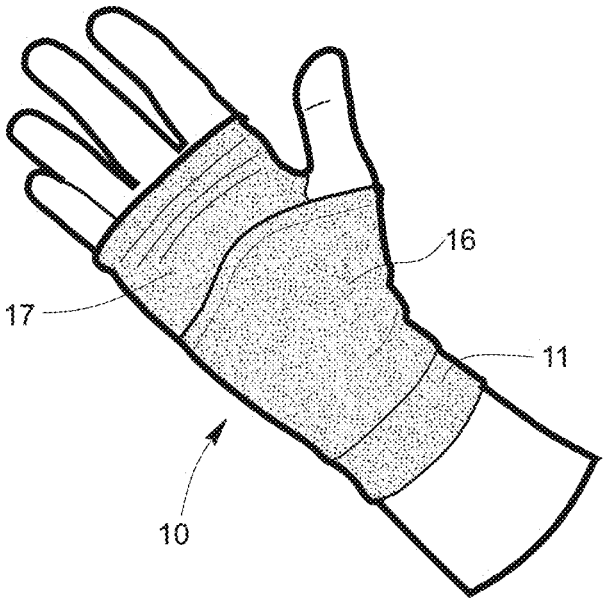
FIG. 6 is a perspective view of the transformable glove wherein a user has stowed the finger/thumb cover as well as pulled back fingers sleeve slightly, completely exposing fingers.

FIG. 6 shows a front perspective view of a user's hand wearing glove 10 with the palm panel 17 (preferably connected to finger/thumb cover panel 15 and back panel 14 not shown in this view) pushed down slightly to expose all fingers allowing user full access to fingers.

Figure 7:
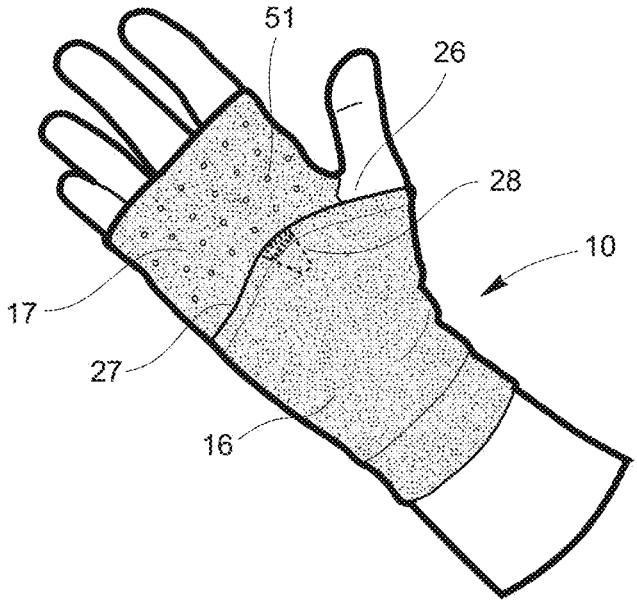
FIG. 7 is a perspective view of the transformable glove on right hand wherein a user has stowed the finger/thumb cover but left fingers partially covered by fingers sleeve.

FIG. 7 shows a front perspective view of a user's right hand wearing glove 10. In this view, the user's right thumb extends through the right thumb hole 26 which is preferably formed by fastening the palm heel panel 16 to the palm panel 17 with a fastening stitch 28, preferably slightly overlapping the panel 17 with panel 16 slightly such that when the thumb holes 26 and or 27 are not in use this preferable overlap hides the feature as well as seals the area from the elements.

Optional palm grip detail dots 51 are provided if extra grip in palm area is desired. The palm grip detail dots 51 can take many forms different from the shown dot shape shown and be accomplished in a variety of manufacturing methods. For example, dots, lines or other shapes of rubber/silicone can be silk screened/applied onto panel 17 or shapes can be heat applied, pressure-formed or otherwise integrally formed or added to accomplish the desired gripping function. Also grip dots 51 can take other forms and shapes such that they act as a grip/grab area to facilitate removal of gloves and or add structural integrity to this area if desired.

Figure 8:
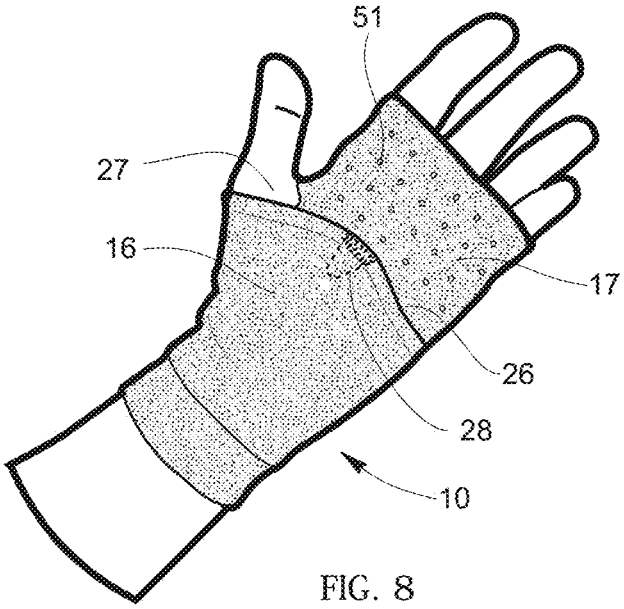
FIG. 8 is a perspective view of the transformable glove on left hand wherein a user has stowed the finger/thumb cover but left fingers partially covered by fingers sleeve. Optional grip texture or the like is shown on palm area.

FIG. 8 shows a front perspective view of a user's left hand wearing the same glove 10 with the user's left thumb extending through left thumb hole 27, such that it can be seen that illustrated version of the glove 10 can be worn on either hand.

Figure 9:
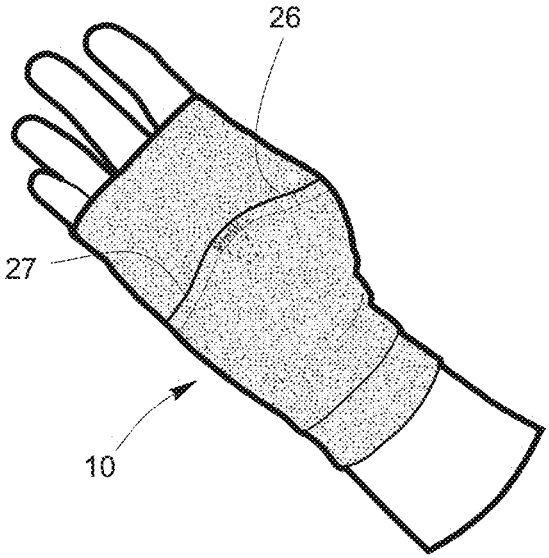
FIG. 9 is a perspective view of the transformable glove on right hand wherein a user has stowed the finger/thumb cover but left fingers partially covered and placed thumb inside fingers sleeve.
Figure 10:
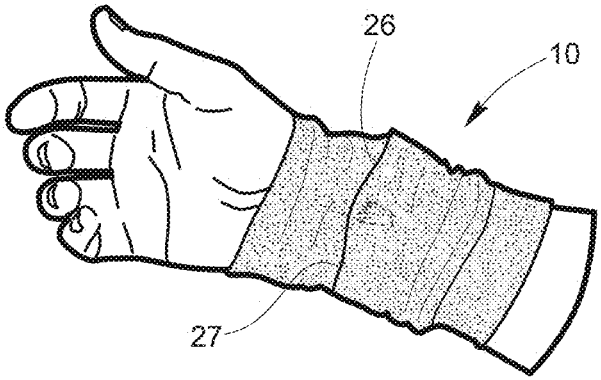
FIG. 10 is a perspective view of the transformable glove on right hand wherein a user has slid hand completely through fingers sleeve such that hand is completely exposed and glove resides on wrist.

FIG. 9 shows the glove 10 with right thumb not extending through right thumb hole 26. If user desires extra protection for thumb from the cold/elements user can place thumb inside sleeve as shown in FIG. 9 and from this position shown in FIG. 9 the user can slide the glove onto the wrist as shown in FIG. 10. As previously disclosed the left thumb hole 27 and right thumb hole 26 are preferably formed by slightly overlapping the palm panel 17 with the palm heel panel 16 and preferably fastening these two panels together centrally with fastening stitch 28 (see FIG. 8) such that it can be seen in FIG. 9 that thumbholes 26 and 27 are stretched flat/closed to the elements.

Figure 11:
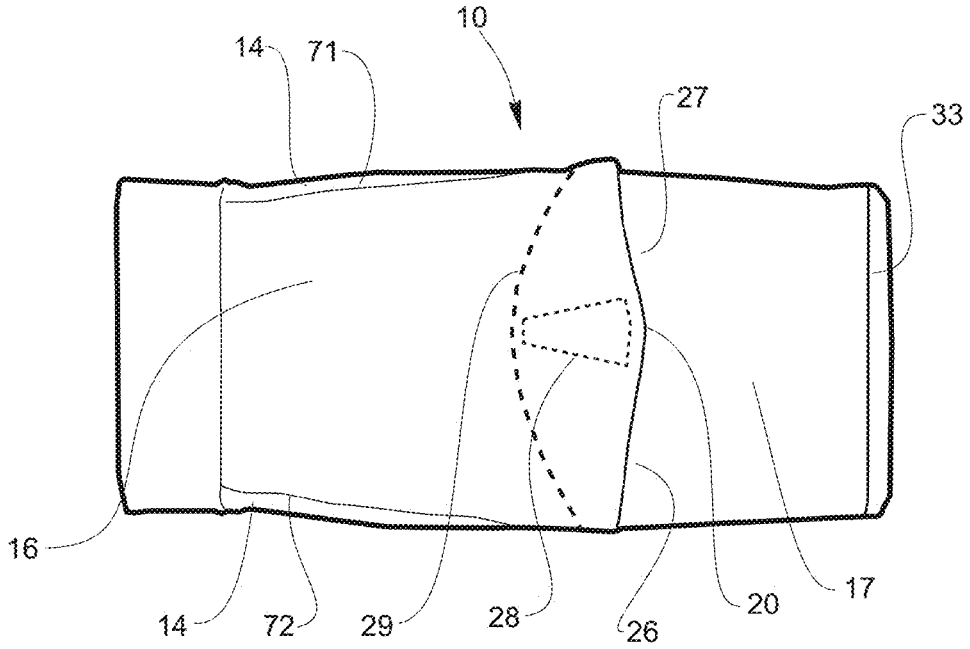
FIG. 11 is a front view of the transformable glove, finger/thumb cover is stowed.

FIG. 11 shows a front view of glove 10, having a preferred hidden palm panel thumbhole edge 29. Palm panel 17 preferably extends to the edge 29 under the palm heel panel 16 and is held in place therein by a fastening stitch 28. Palm heel panel 16 extends over the palm panel 17 to the palm heel panel edge 20 where the thumb openings 26 and 27 are formed. The palm heel panel further is attached to the back panel 14 along seams 71 and 72. The palm panel 17 extends in the opposite direction from the edge 29 to the palm panel front edge 33.

Figure 12:
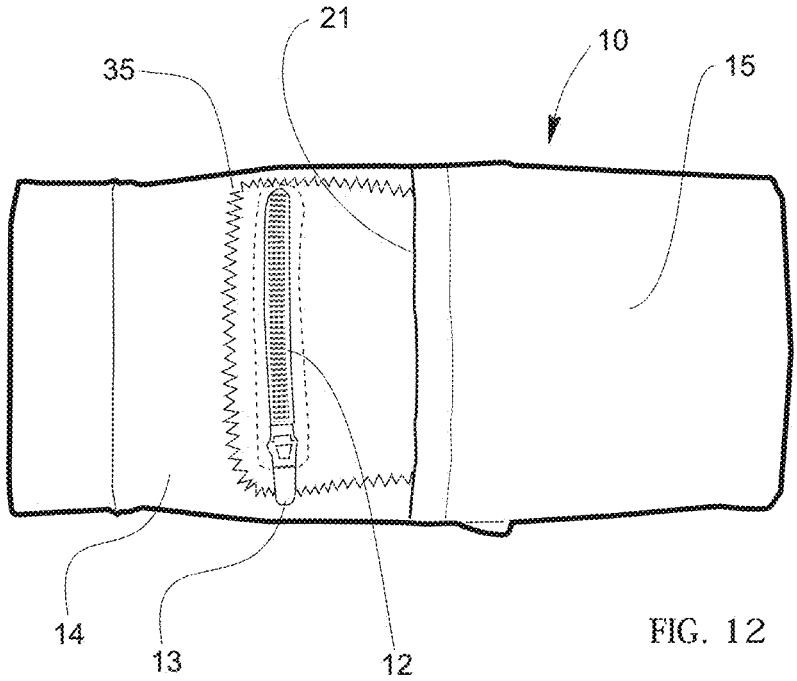
FIG. 12 is a back view of the transformable glove, finger/thumb cover is stowed.

FIG. 12 shows a back view of the glove 10 (FIG. 11 being a front view) wherein the finger/thumb cover panel 15 is shown in a stowed position lying over the back panel 14. When the user desires to deploy the finger/thumb cover panel such that it is covering and protecting the fingers/thumb from the elements, the user would hold the finger/ thumb cover panel edge 21 and the reverse finger/thumb cover panel 15 over the fingers.

Figure 13:
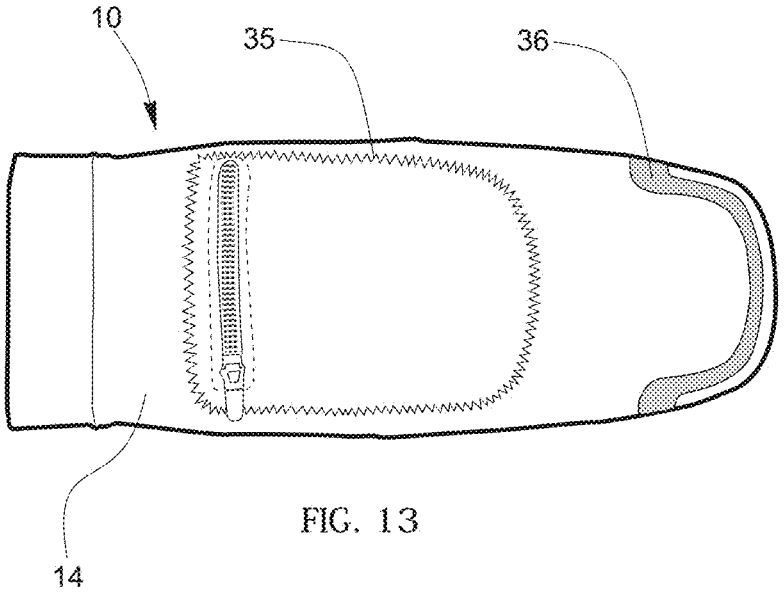
FIG. 13 is a back view of the transformable glove with finger/thumb in deployed position.
Figure 14:
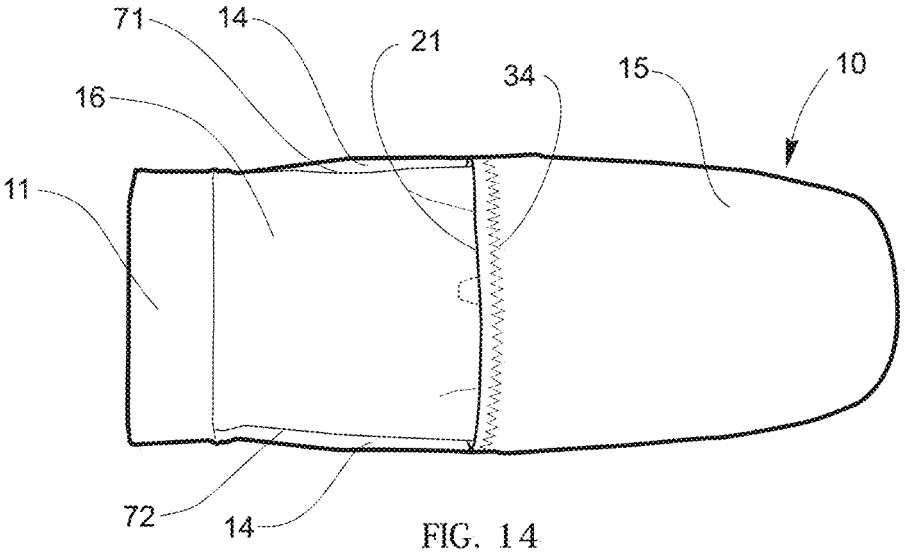
FIG. 14 is a front view of the transformable glove with finger/thumb in deployed position.

FIG. 13 is a back view and FIG. 14 is a front view of the result of a user reversing the panel 15 thereby covering the fingers (as shown on a hand in FIG. 3) and fingers/thumb (as shown on a hand in FIG. 4 and FIG. 5). FIG. 13 further shows a pocket perimeter stitch 35 which preferably connects a panel to panel 14 thereby forming a pocket which is preferably accessed by the preferable zipper closure shown. Ribbing element 36 shown in FIG. 13 is an example of a preferable feature that adds structure to the glove 10 such that the finger/thumb cover repeatably stows in a predictable manner lying over back panel 14. The ribbing element 36 is preferably heat applied or sewn on reflective material such that it adds a secondary function of adding reflective visibility to the glove, though; further, the desired result of adding structure could be achieved in many other ways such as ultrasonic applied, sewn, glued, heat applied, integrally formed features/material, screened on silicone, vinyl material or the like. More will be described later about preferable features (like preferable element 36) which add desired structure to the preferable glove thereby making the fingers/thumb cover stow in a desired repeatable manner.

FIG. 14 further shows a finger/thumb cover edge binding 34 (shown with a zig-zag stitch) which is preferably edged in a manner to prevent this panel edge from fraying while further allowing this edge 21 to stretch such that it can be easily reversed thereby allowing the deploying/stowing of finger/thumb cover. This preferable edging 34 along the panel edge 21 protects this edge but allows this edge 21 (and panel 15) to reverse easily such that panel 15 can be easily moved from deployed position (as in FIG. 13 and FIG. 14) to stowed position (as in FIG. 11 and FIG. 12). Panel 15 further can be gathered along edge 21 and edged with a stretchy edging to allow this panel 15 to deploy more easily (for example in the case of less stretchy material being used for panel 15 such as polar fleece, fabrics laminated with a water proof/resistant layer such as gore-tex or the like, leather or leather-like materials or other technical fabrics).

Figure 15:
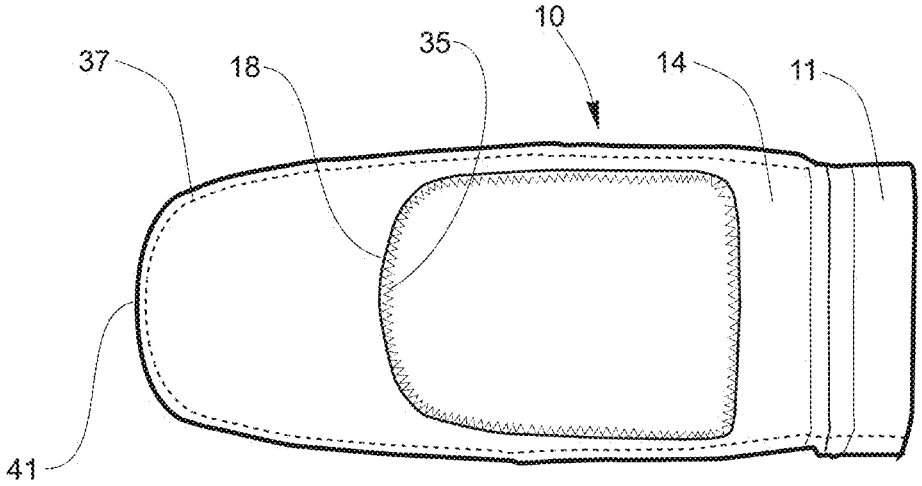
FIG. 15 is a back view of the transformable glove. Glove is turned inside out to show construction.
Figure 16:
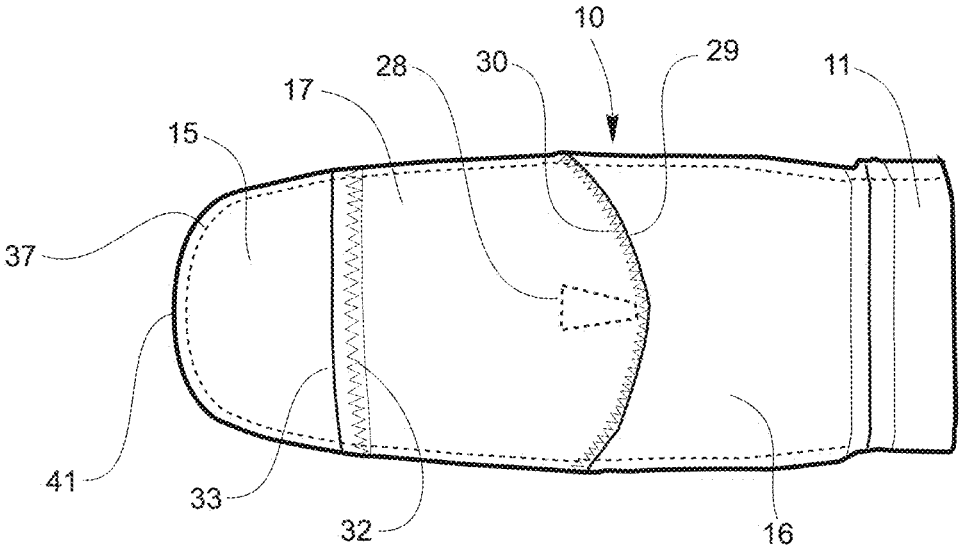
FIG. 16 is a front view of the transformable glove. Glove is turned inside out to show construction.

FIG. 15 and FIG. 16 show back view and front view (respectively) of a preferred glove 10 turned inside-out such that construction of the preferred glove 10 can be more simply understood. The glove 10 is preferably constructed inside-out as shown in FIG. 15 and FIG. 16 such that first, palm panel 17 is laid down then palm heel panel 16 (preferably overlapping palm panel 17 slightly and preferably stitching together the palm panel 17 and the palm heel panel 16 with stitching 28), then the finger panel 15 is laid down, then the back panel 14 (which has pocket panel 18 preferably pre-assembled to it). This layering of panels is preferably stitched around its perimeter along stitching 37 such that all panels are assembled together, leaving an opening for insertion of the hand at the palm heel panel 16. Preferably a cuff 11 can be assembled at this point or earlier in the process, providing a finished band at the edge of the palm heel panel.

A pocket panel 18 is preferably assembled to back panel 14 by stitching around the perimeter of the pocket panel along the edge indicated by stitch 35 such that a pocket is formed between the pocket panel 18 and the back panel 14. The palm panel 17 is preferably bound such that its distal edge 33 and proximal edge 29 do not fray by binding as indicated at 32 and 30 respectively. Edge binding of the finger panel 15, palm heel panel 16 and palm panel 17 and be accomplished in a number of ways. Generally the edge binding of panels is preferably done before the panels are assembled but in some case it may be desirable to be done after for specific edging and desired results. Panel 17 is preferably turned over along edge 33 and zig-zag stitched along 32 and simply serger or zig-zag stitched along 30. Panel 16 is preferably turned over along edge 20 and zig-zag stitched along 31 (see FIG. 17).

In accordance with the description above and as illustrated, the back panel is preferably an elongated panel having a length that extends from a proximal end at a user's wrist to a distal end at the user's fingertips. The finger panel 15 is much shorter, and in a preferred version the finger panel is between about half and about two thirds, or between about one half and three quarters, of the length of the back panel. The finger panel extends from the distal end of the back panel toward the proximal end of the back panel, but because of its shorter length the distal end of the finger panel stops short of the distal end of the back panel. The palm heel panel 16 extends from the proximal end of the back panel toward the distal end, but in the preferred version the palm heel panel is less than about half the length of the back panel and therefore the distal end of the palm heel panel stops well short of the distal end of the back panel. As illustrated, preferably the combined length of the finger panel 15 and the heel panel 16 is greater than the length of the back panel such that the distal end of the palm heel panel 16 will overlap somewhat with the proximal end of the finger panel 15. In preferred examples, the two panels will overlap by about one half inch to about one inch. The palm panel 17 is preferably about one quarter to about one third of the length of the back panel 14. As illustrated, the proximal end of the palm panel 17 overlaps somewhat with the distal end of the palm heel panel 16, with the palm panel 17 extending toward the distal end of the glove, preferably terminating at a location intermediate the length of the finger panel 15. In a preferred version, the palm panel 17 terminates at a point between about one half and two thirds, or between about one half and three quarters, of the distance from the proximal end of the finger panel toward the distal end of the finger panel 15.

Figure 17:
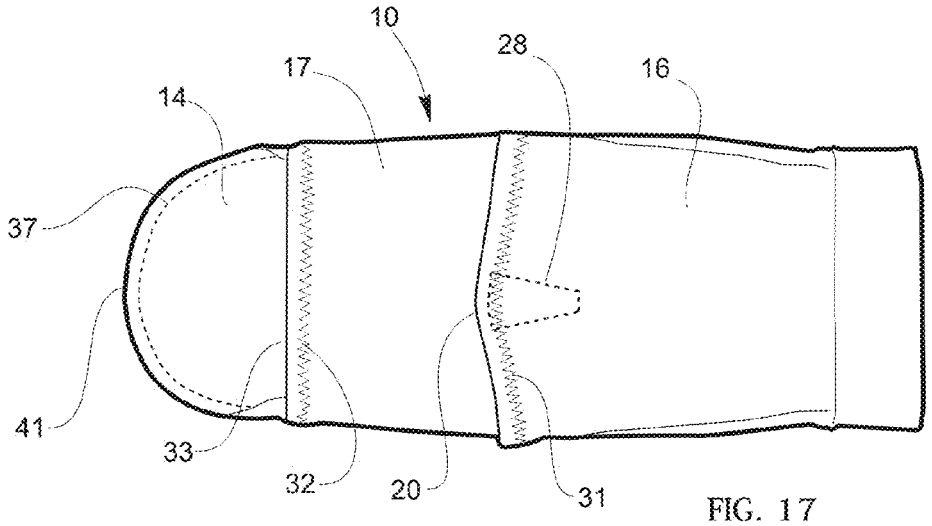
FIG. 17 is a front view of the transformable glove. Normally hidden finger/thumb cover is turned out to show construction.
Figure 18A:
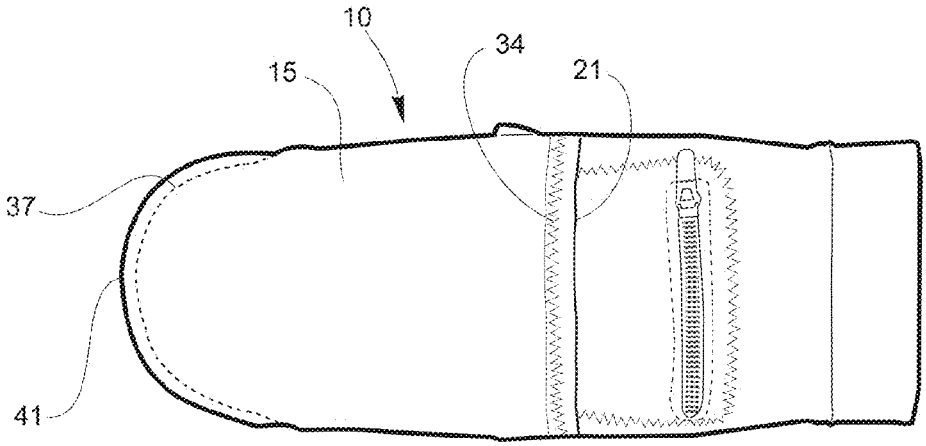
FIG. 18*a* is a back view of the transformable glove. Normally hidden finger/thumb cover is turned out to show construction.

FIG. 17 and FIG. 18*a* show front view and back view (respectively) of preferable glove 10 (right side out) with fingertip cover portion 41 turned out; that is, the finger panel 15 is folded over so that it no longer directly overlies the palm panel 17. In this configuration, the inside-out surfaces of the fingertip pocket 41 can be seen and the preferred construction of glove 10 can be more simply understood.

Figure 18B:
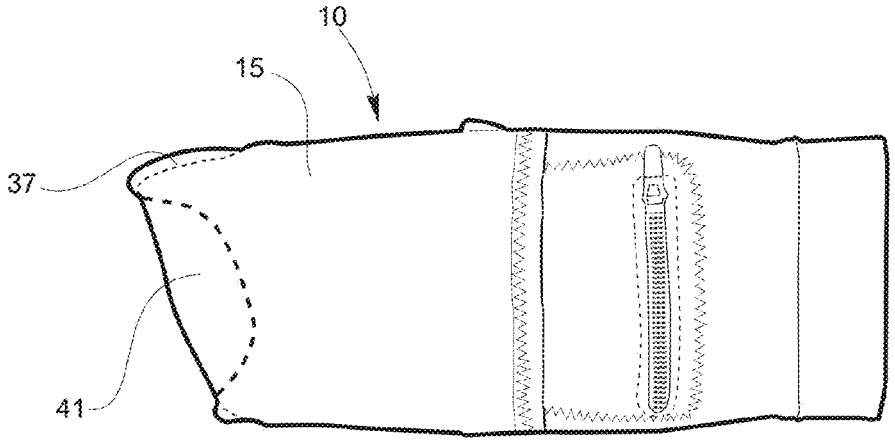
FIG. 18*b* is a back view of the transformable glove. Normally hidden finger/thumb cover is partially turned out.
Figure 19:
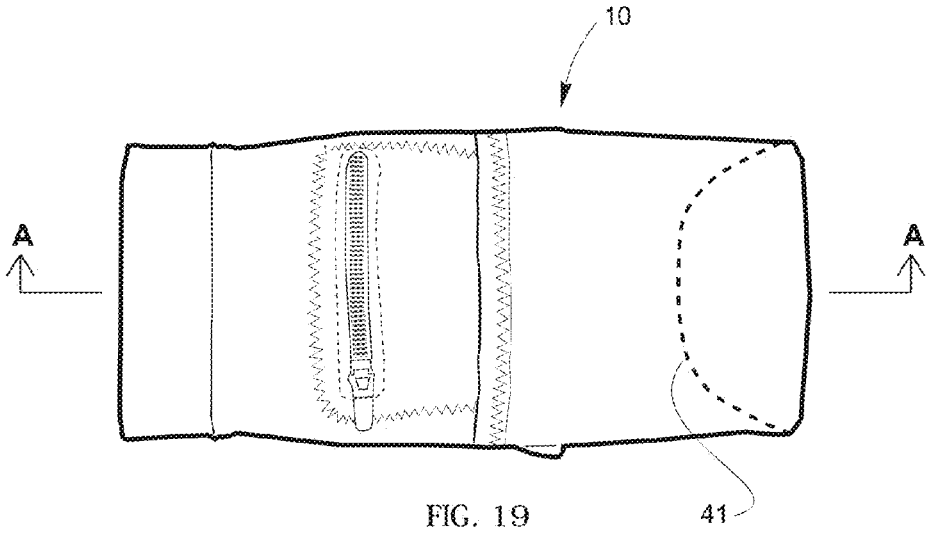
FIG. 19 is a back view of the transformable glove. Normally hidden finger/thumb cover is turned-in to normal position, hidden line showing its normal position.
Figure 20:
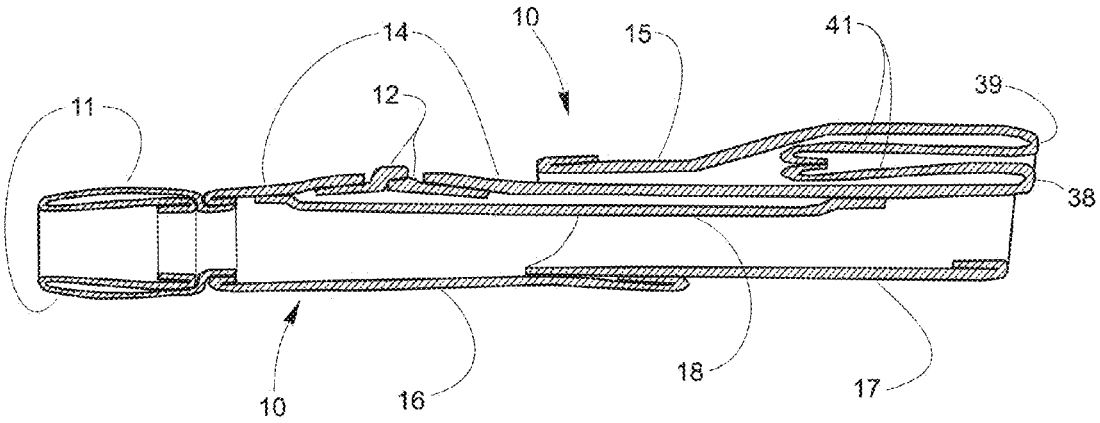
FIG. 20 is a section view (enlarged to show detail) of the transformable glove taken through section A-A in FIG. 19.

FIG. 17, FIG. 18*a* and FIG. 18*b* show views of glove 10 that normally would not be seen by a user unless the user purposely chose to pull fingertip cover portion 41, defined by the finger panel 15, out from its normal stowed position shown (see FIG. 19 and FIG. 20 for normal stowed position). Also, FIG. 18*a* and FIG. 18*b* show glove 10 wherein finger cover portion 41 fails to stow properly after a user has moved finger/thumb cover panel 15 from deployed to stowed position. In FIG. 18*b* a portion of the finger pocket 41 is shown in hidden line because it is partially stowed/reversed-out such that it is partly hidden as shown by hidden line (see FIG. 19 as an example of 41 being fully stowed). Because of disclosed preferable geometry and structure elements further disclosed herein, normally fingertip cover portion 41 resides hidden in stowed position (FIG. 19 shows 41 with a hidden line as it is not visible in this view). In stowed position fingertip cover portion 41 (which is preferably comprised of an extended portion of back panel 14 and an extended portion of finger/thumb cover panel 15) extends from fold line 38 in back panel 14 and fold line 39 in finger/thumb cover panel 15 such that it resides doubled back between panel 14 and panel 15.

Figure 21:
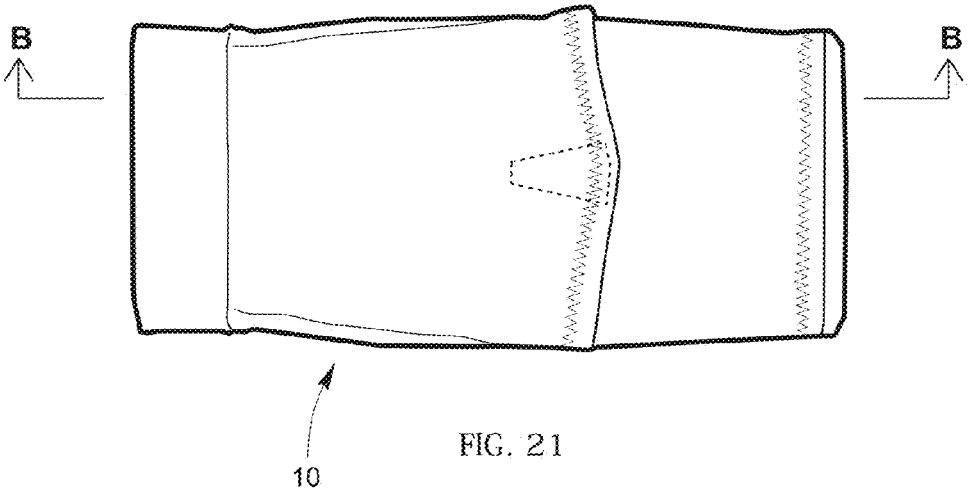
FIG. 21 is a front view of the transformable glove. The fingers/thumb cover is stowed.
Figure 22:
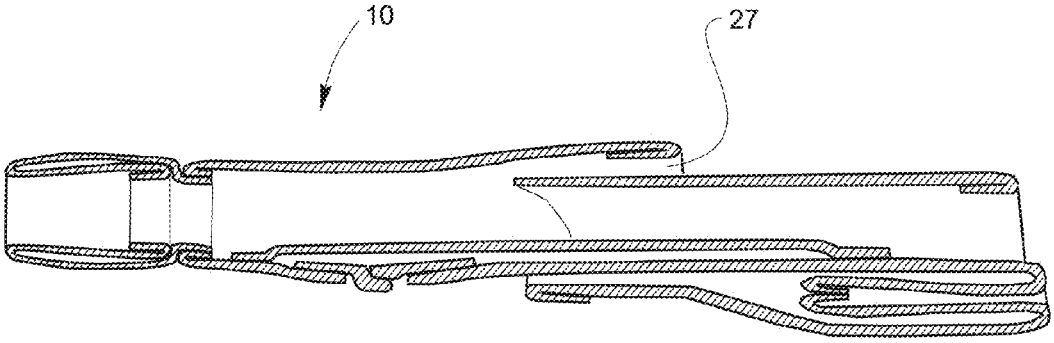
FIG. 22 is a section view (enlarged to show detail) of the transformable glove taken through section B-B in FIG. 21.

FIG. 19 and FIG. 20 show glove 10 with fingertip cover portion 41 in normal stowed position. FIG. 20 is a section view of FIG. 19 taken through section lines A-A. FIG. 22 is a section of glove 10 taken through section lines B-B of FIG. 21 so that left thumb hole 27 (and right thumb hole 26) can be more easily understood. The glove 10 is preferably symmetrical about an axis of symmetry taken through section A-A of FIG. 19 thus the geometry of right thumb hole 26 can also be understood from FIG. 22.

Figure 23:
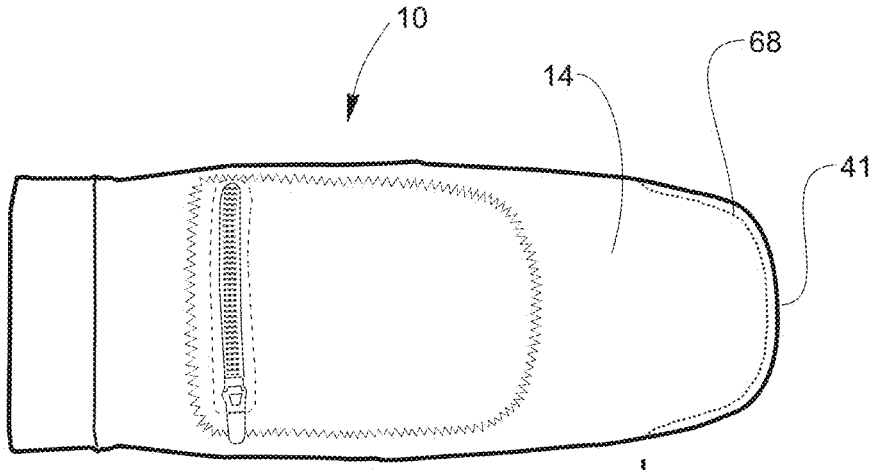
FIG. 23 is a back view of an embodiment of the transformable glove. The fingers/thumb cover is deployed.
Figure 24:
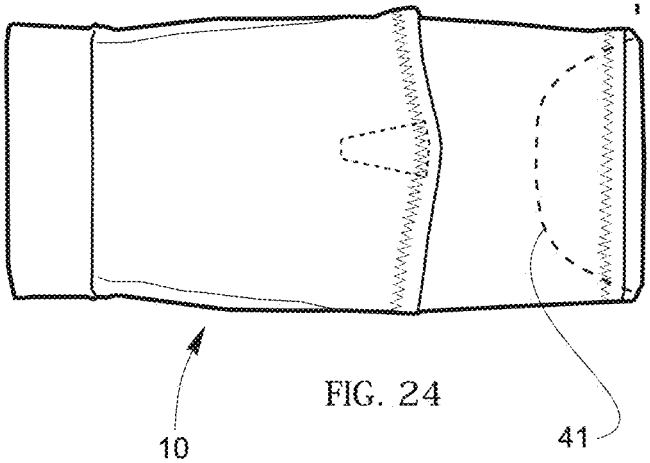
FIG. 24 is a front view of the transformable glove. The fingers/thumb cover is stowed. The broken line between FIG. 23 and FIG. 24 lines up features (as will be discussed later in detail) between these two views.
Figure 29:
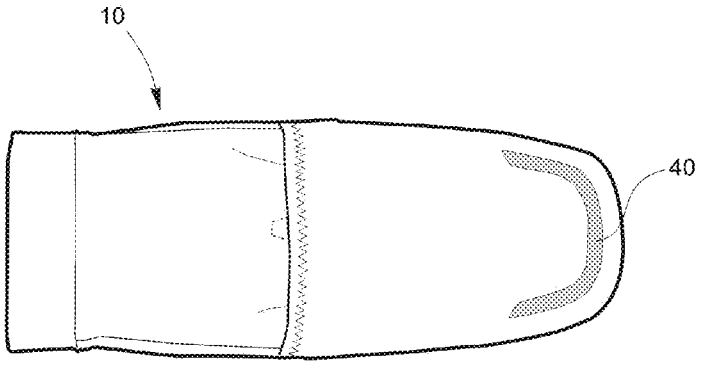
FIG. 29 is a front view of the transformable glove.
Figure 30:
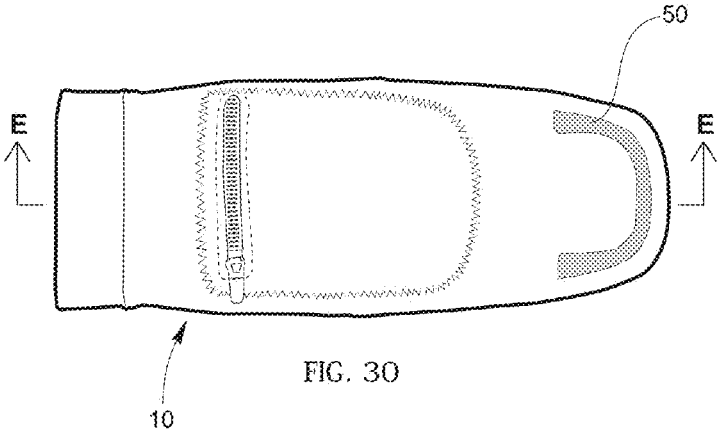
FIG. 30 is a back view of an embodiment of the transformable glove. The fingers/thumb cover is deployed.
Figure 31:
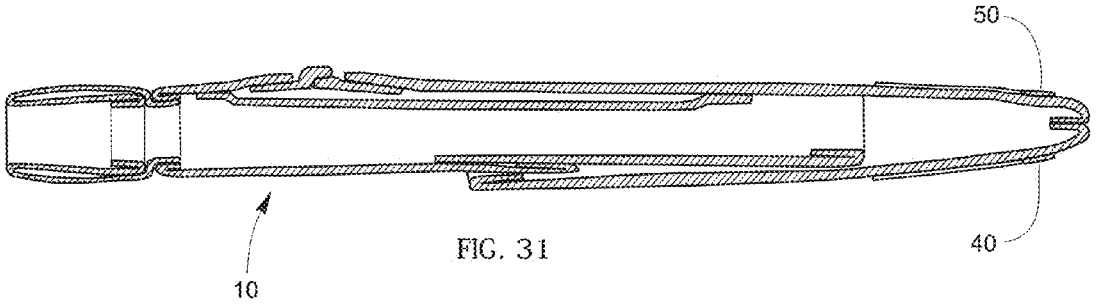
FIG. 31 is a section view (enlarged to show detail) of the transformable glove taken through section E-E in FIG. 30.

FIGS. 23 through 42 relate to structural and other construction elements for fingertip pocket 41 of glove 10. A portion of the fingertip pocket 41 FIG. 24 is shown in broken lines because it is not visible in this view, and is constructed in such a way that it stays hidden/recessed until finger/thumb cover panel 15 is pulled/reversed-out from its stowed position (good examples seen in FIG. 1, FIG. 19 and FIG. 20) to its deployed position (good examples are seen in FIG. 3, FIG. 4, FIG. 29, FIG. 30 and FIG. 31). Some methods of accomplishing a consistent stowing of the fingertip portion 41 are more preferable than others. In FIG. 23 glove 10 is shown with a usually less preferable method stitch line 68, wherein stitch line 68 is preferably sewn through panels 14 and 15 such that it biases fingertip portion 41 such that when it is stowed as shown in FIG. 24 it is biased to stay in this position instead of protrude out as shown in FIG. 17 and FIG. 18. The biasing effect of stitch line 68 can be accomplished in a number of ways for example the fingertip portion 41 could be heat pressed to a biased flat position in this fingertip area or glued, formed or other biasing means could be provided such as material applied and/or formed in this region stitch line 68, although generally providing biasing means as shown in this figure is less preferable than the disclosed more preferable methods. It should be noted that the when glove 10 is transformed by user from deployed to stowed positions as shown in FIG. 31 and FIG. 20 respectively if proper care in constructing glove 10 is not taken, glove 10 will not perform as desired, fingertip portion 41 will not stow properly, but will stow only partially (example shown in FIG. 18*b*) or not stow at all (as shown in FIG. 17 and FIG. 18*a*). Glove 10 with improperly stowed fingertip portion 41 for most uses is not desired as fingertip portion 41 gets in the way of glove/hand use, can be unsightly, undesirable and/or unfinished looking.

FIGS. 23 through 42 (and others) along with the descriptions herein, show how the glove 10 can be constructed such that fingertip portion 41 stows properly in a repeated and reliable manner (some methods disclosed are more preferable than others and more preferable methods are disclosed as such). It also should be noted that gloves in general are washed in washing machines, dried in dyers and used in conditions that can alter the glove and wear the glove's material and construction. The preferred disclosed methods for constructing fingertip portion 41 are designed for these normal kinds of use and cleaning conditions, such that the stowing function will continue to work as desired even after repeated use/wash/dry cycles. It can be understood that for some uses it could be desirable to construct a glove with fingertip portion 41 designed such that it does not stow at all or that it stows partially. Although this is not as desirable in most cases for the reasons discussed above it can be seen that for some uses it could be desirable to construct a glove in this manner.

Figure 61:
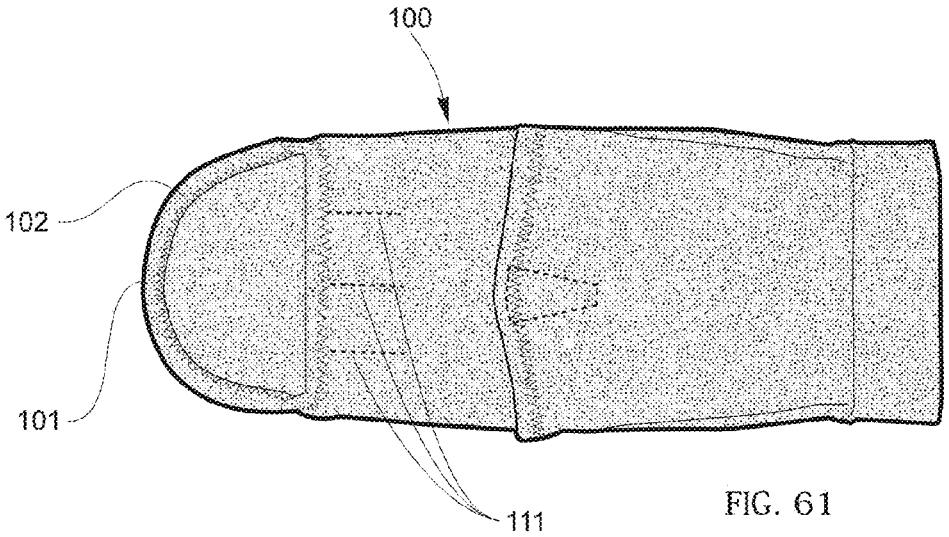
FIG. 61 is a front view of a less preferable embodiment of the glove.

FIG. 61 shows an example of a version of a glove 100 wherein a fingertip portion 101 has edge binding 102 such that the edge binding 102 goes around the opening such that it somewhat controls the shape of the opening as shown in FIG. 61.

Figure 25:
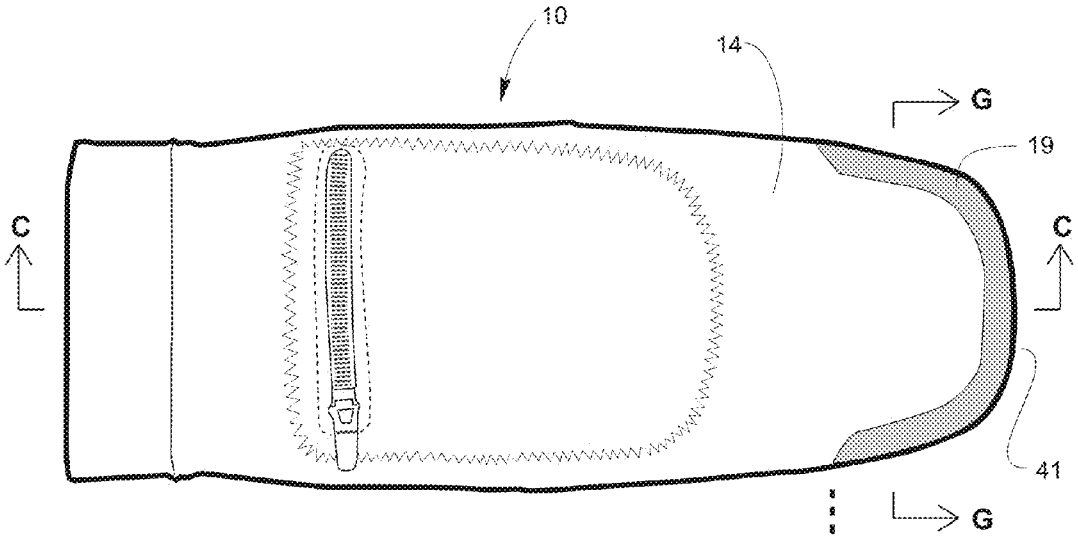
FIG. 25 is a back view of an embodiment of the transformable glove. The fingers/thumb cover is deployed.
Figure 26A:
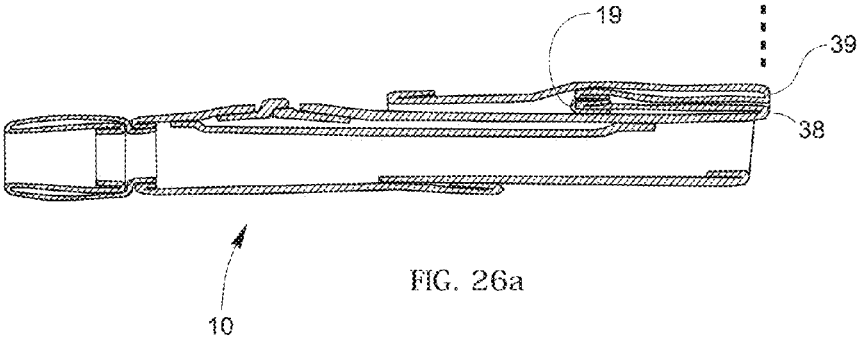
FIG. 26*a* is a section view of the transformable glove taken through section C-C in FIG. 25 but fingers/thumb cover is shown in stowed position in this view unlike in FIG. 25 (which is shown in finger/thumb panel deployed position). The broken line between FIG. 25 and FIG. 26 lines up features (as will be discussed later in detail) between these two views.
Figure 26B:
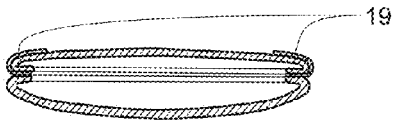
FIG. 26*b* is a section view of the transformable glove taken through section G-G of FIG. 25.
Figure 26C:
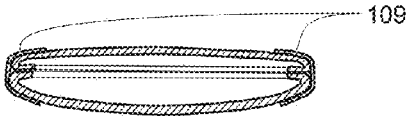
FIG. 26*c* is an alternate embodiment of a section view of the transformable glove taken through section G-G of FIG. 25 labeled item 109 would be an alternate embodiment of the cross-section of 19 of FIG. 25.
Figure 27:
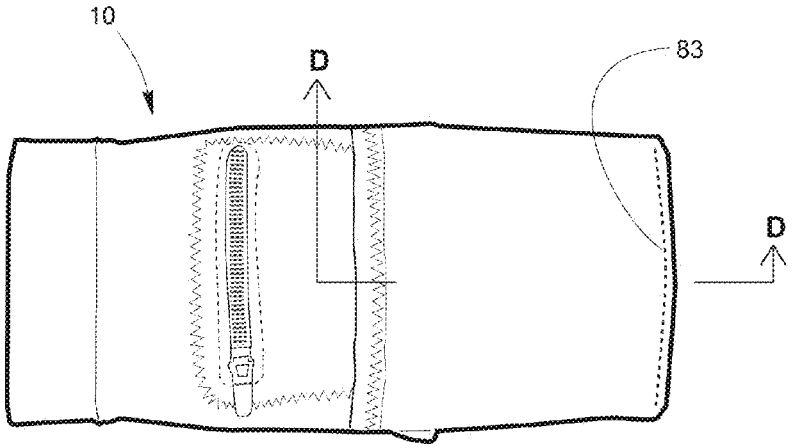
FIG. 27 is a back view of an embodiment of the transformable glove. The fingers/thumb cover is stowed.
Figure 28:
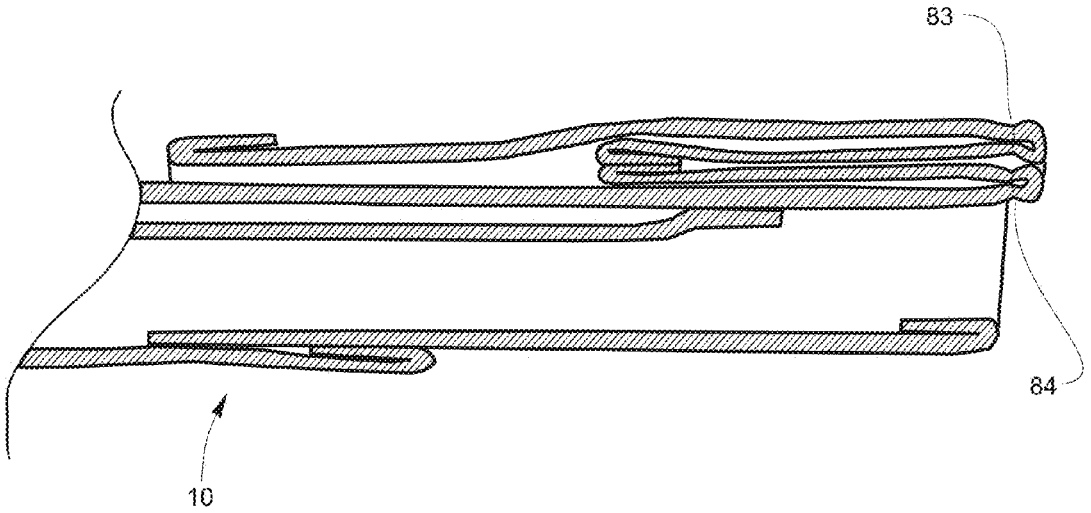
FIG. 28 is a section view (enlarged to show detail) of the transformable glove taken through section D-D in FIG. 27.

FIG. 25, FIG. 26*a* and FIG. 26*b* show glove 10 with a preferable structural element 19 that facilitates the repeatable stowing of the fingertip area of glove 10. Structural element 19 is preferably a sewn on, heat applied, silk screened on, or otherwise affixed on material (preferably to panel 14) that preferably stiffens this fingertip area 41 locally and provides some structure such that it provides resistance for fingertip portion 41 from flipping inside-out easily and as a user transitions glove 10 from finger/thumb panel deployed to stowed positions this locally stiffened area also provides a hinge or bend line 38 (FIG. 20) that further facilitates the proper desired stowing of fingertip portion 41 as seen in FIG. 20. FIG. 26*c* shows an less preferable alternate embodiment wherein element 109 which has taken the place of element 19 shown in the previous figures wraps around the seam and is affixed in this manner such that it substantially wraps around the nose of fingertip portion 41 providing desired structure such that it provides resistance for 41 from turning inside-out. In FIG. 27 and FIG. 28 glove 10 is shown with a usually less preferable stitch line 83 and 84, wherein stitch line 83 is preferably sewn through panel 15 and stitch line 84 is preferably sewn through panel 14 such that it biases fingertip portion 41 such that when it is stowed as shown in FIG. 28 it is biased to stay in this position instead of protrude out as shown in FIG. 17, FIGS. 18*a* and 18*b*. The biasing effect of stitch line 83 and 84 can be accomplished in a number of ways for example the fingertip portion 41 could be heat pressed to bias and crease this area flat and/or formed or other biasing means could be provided such as material applied and/or formed in these regions 83 and 84 such that this creasing/biasing means is achieved. Also a separate panel or panels could be used in this fingertip area 41 such that the fingertip area of panel 14 and/or panel 15 is replaced with a separate panel attached along stitch line 83 and/or 84. An example of how this could look as seen from a back view of glove 10 is FIG. 37. Although, generally providing biasing means as shown in FIG. 27 and FIG. 28 is less preferable than the disclosed more preferable methods. FIG. 29, FIG. 30 and FIG. 31 show glove 10 with another preferable embodiment of structural elements 40 and 50 wherein a sewn on, heat applied, silk screened on, or otherwise affixed on material (preferably to panel 14) that preferably stiffens fingertip area 41 locally and provides some structure such that it provides resistance for fingertip portion 41 from flipping inside-out easily and as a user transitions glove 10 from finger/thumb panel deployed to stowed positions this locally stiffened area also provides a hinge or bend line 38 (FIG. 20) that further facilitates the proper desired stowing of fingertip portion 41 as seen in FIG. 20. Element 40 is applied to panel 15 wherein both elements 40 and 50 both provide resistance for fingertip portion 41 from flipping inside out as well as 40 provides a hinge or bend along 39 bend line and 50 provides a hinge or bend line along 38 bend line. Also elements 40 and 50 further provide a gripping feature for when a user wishes to remove glove 10 and if this feature is applied in a reflective material also adds retro-reflective visibility to the glove. It should be noted that adding/forming or otherwise providing structural elements such as 40 and 50 as disclosed herein can be accomplished on the back panel 14 and/or the finger panel 15 (on the inside of the panel, on the outside and/or integrally formed into the panel and/or by other means that achieve the desired resistance to the finger pocket 41 being turned inside-out and/or the desired fold locations), though it is most preferable for its desired purpose applied/formed or otherwise provided on back panel 14 as seen in FIG. 30 with a preferable element 50.

Figure 32:
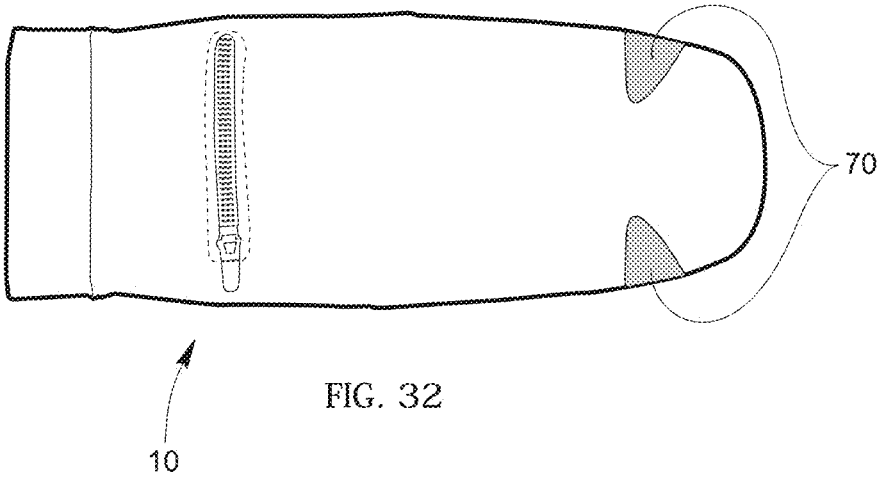
FIG. 32 is a back view of an embodiment of the transformable glove.

FIG. 32 shows glove 10 with an optional structural or stiffening element 70 similar the previously discussed element 19 shown in FIG. 25, although the stiffening element 70 is formed with two separate portions to provide the desired function. Similar to stiffening element 19, element 70 is preferably applied and then sewn into the seam such that it provides somewhat of a barrier from panel 41 being turned inside-out as well as a hinge line or fold edge along fold line 38 (as shown in FIG. 20). To further understand how this element is preferably sewn into the seam on either side see FIG. 26*b* wherein element 19 is sewn into the seam in a similar way. It should be noted that the manner in which structural element 19 of FIG. 26*b* as well as element 70 of FIG. 32 is preferably sewn into the seam provides a desirable resistance to being turned inside out, partially due to the somewhat flattened, curved (in cross-section geometry) as can be view in FIG. 26*b* element 19.

Figure 33:
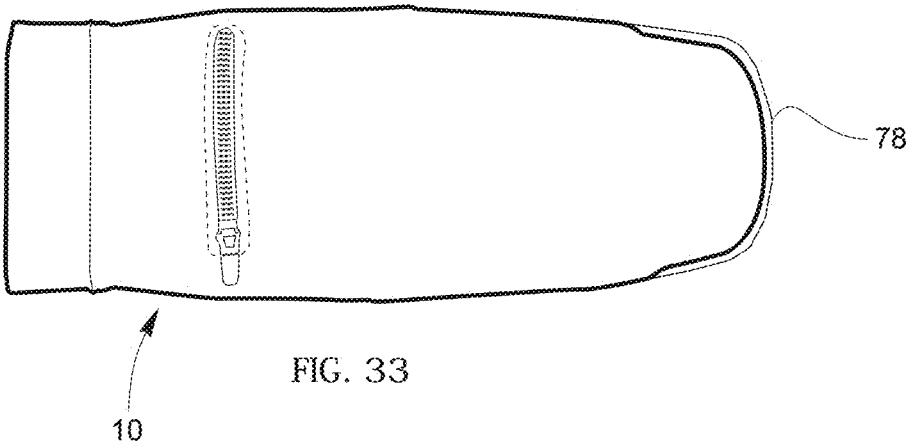
FIG. 33 is a back view of an another embodiment of the transformable glove.
Figure 34:
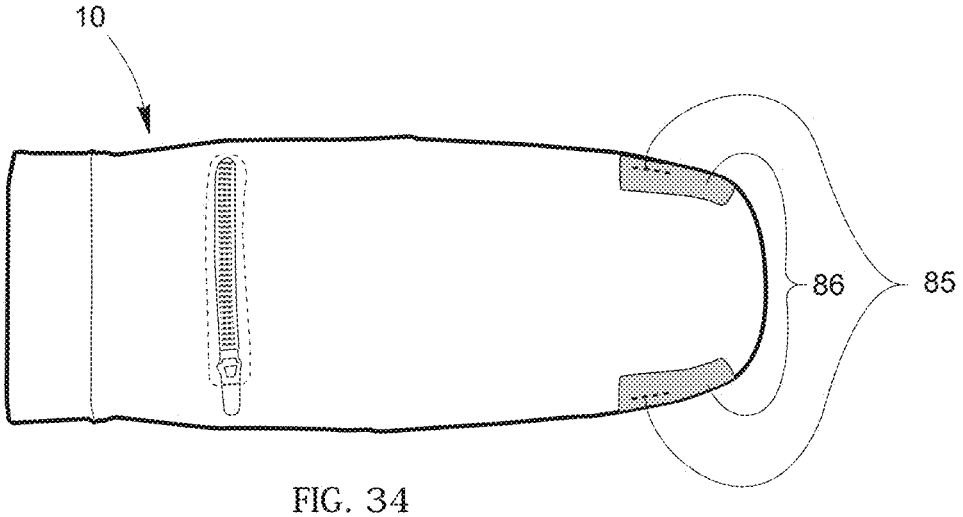
FIG. 34 is a back view of an another embodiment of the transformable glove.

FIG. 33 shows another preferable structural element 78, preferably applied to fingertip portion 41 to repeatedly achieve the desired stowing of 41. Element 78 is preferably reflective piping or other similar stiffening member that preferably wraps around the fingertip portion 41 and is preferably sewn into the seam such that it provides the desired structure. Element 78 could be applied in many ways around the nose or periphery of 41, including sewn into the seam between panel 14 and 15, as traditional piping, heat applied, glued, sewn on or otherwise applied as appliqué, etc. FIG. 33 shows other exemplary structural elements 86, preferably applied to fingertip portion 41 to repeatedly achieve the desired stowing of 41. Elements 86 are applied similarly to element 70 preferably applying a sheet material, decal of some structure, screening on an ink or the like, sewing sheet material in the shape (or similar shape) and placement as elements 86. The elements are preferably applied, integrally formed or the like before panels 14 and 15 are sewn or otherwise affixed together forming fingertip portion 41 such that elements 86 are preferably sewn into the seem between panels 14 and 15 similar to element 70. Optional local stitch or the like elements 85 are then added fastening through panels 86, 14 and 15 such that this fingertip area is constrained. Optional elements 85 can take many forms and provide the similar binding together of panels, such as elements 85 can take the form of rivets, stitching, integrally or insert molded features, this area can be heat sealed together such that a similar binding result is obtained. For most cases the optional elements 85 are not preferable but for some cases and/or some materials (for example used for panels 14 and 15) these fastening elements may constrain this area in a preferable way.

Figure 35:
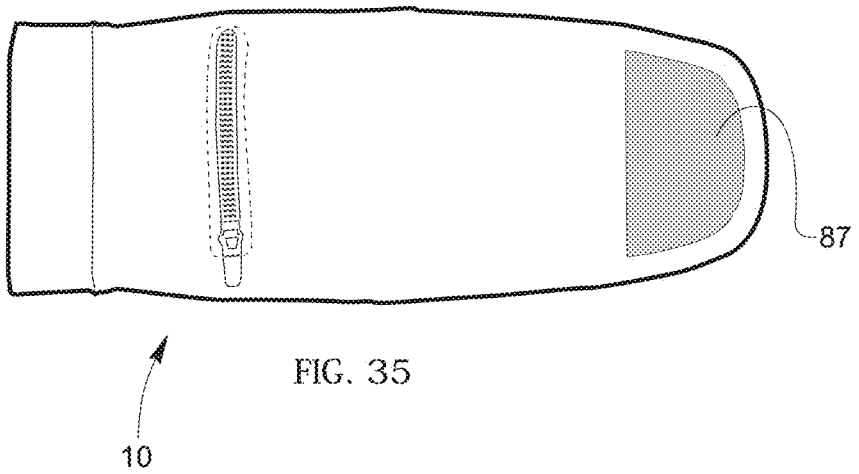
FIG. 35 is a back view of an another embodiment of the transformable glove.
Figure 36:
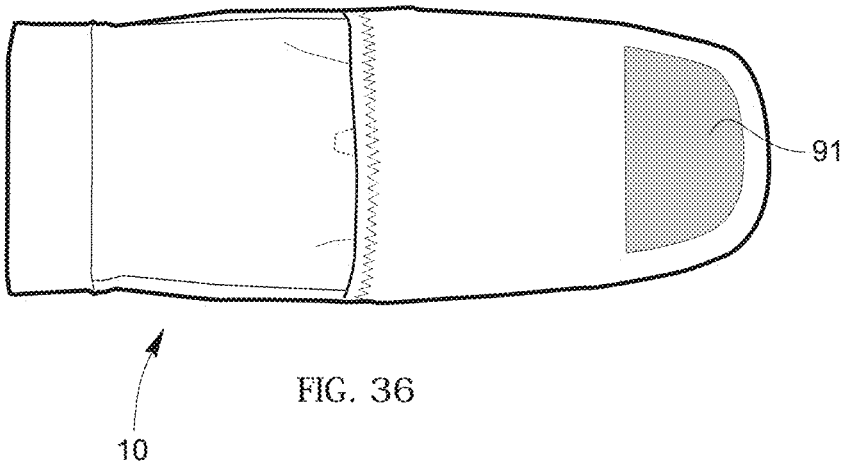
FIG. 36 is a front view of an embodiment of the transformable glove.
Figure 37:
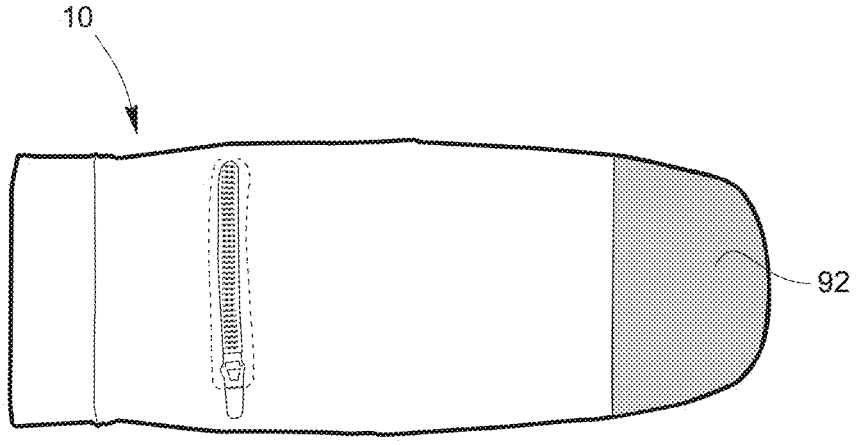
FIG. 37 is a back view of an embodiment of the transformable glove.

FIG. 35, FIG. 36 and FIG. 37 show other preferable structural elements 87, 91 and 92 respectively, preferably applied to fingertip portion 41 to repeatedly achieve the desired stowing of 41. These elements are preferably applied as sections of sheet retro-reflective film/material or the like or other applied material as outlined for other structural elements disclosed above such that they provide the desired structural results such that they help to achieve the desired stowing of 41. Element 92 is depicted as extending all the way into the seam and elements 91 and 87 do not. The disclosed structural elements can be applied and/or integrated into back panel 14 and/or finger/thumb cover panel 15 in the fingertip portion 41 area with varying degrees of success for varying fabrics used for 14 and 15. For most cases it is preferable to integrate the preferable structural elements as disclosed in the back panel 14 in fingertip area 41 to provide the disclosed desirable structure, although for some cases both or one or the other of panels 14 and/or 15 may be desirable may be desirable to have this structure added or integrated into it.

Figure 38:
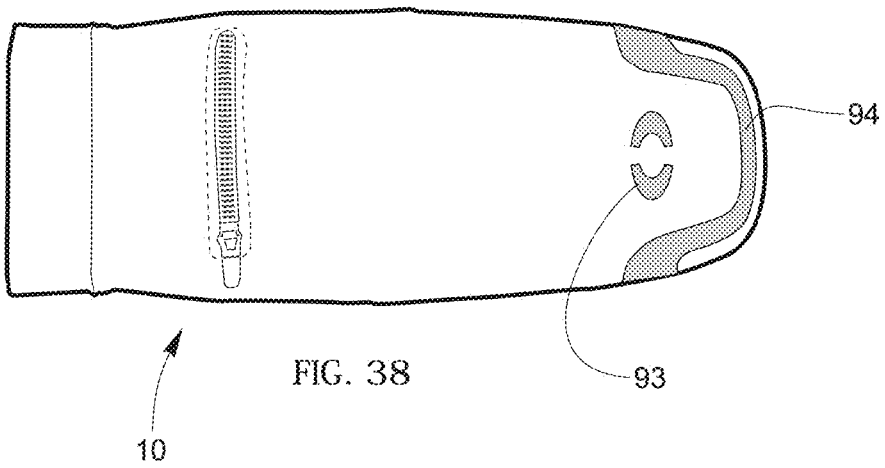
FIG. 38 is a back view of another embodiment of the transformable glove.

FIG. 38 shows another example of a desirable structural element wherein the element is sewn into the seams adjacent the fold line 38 (FIG. 20) and not sewn into the seams toward the nose of glove 10. Also a logo or the like element 93 can be applied in a similar manner such that it facilitated and can itself provide desired structure. It should be noted that the placement and geometry of structural elements is important to the desired function. As shown with the broken line between FIG. 25 and FIG. 26*a* it is important to the function of the structural elements that they provide structure in the desired fingertip 41 area and this structure preferably does not provide stiffening over the fold areas 38 and 39 such that stiffening is provided to facilitate stowing of fingertip area 41 yet fold lines 38 and 39 are facilitated to act as hinge/fold lines.

Figure 39:
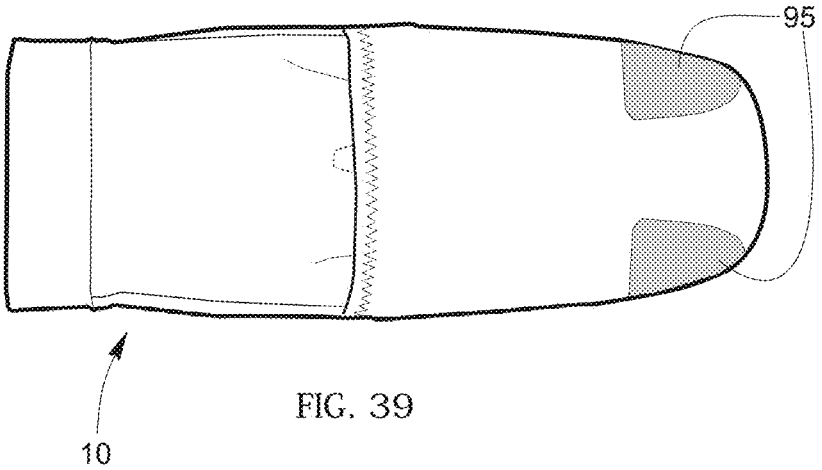
FIG. 39 is a front view of an embodiment of the transformable glove.

FIG. 39 shows elements 95 which are preferably screened on capacitive material or the like that allows a user to actuate a touch screen device while also providing the desired structure.

Figure 40:
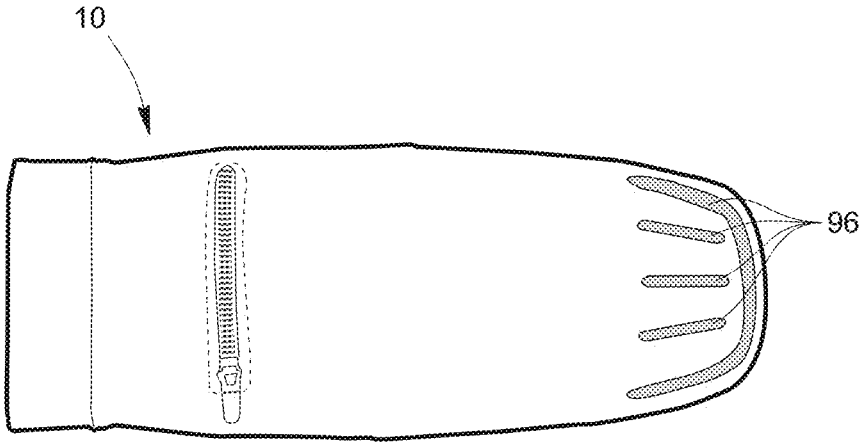
FIG. 40 is a back view of an embodiment of the transformable glove.

FIG. 40 shows elements 96 which are preferably reflective material with clear silicone screened over top such that they provide reflectivity as well as grip (can be applied to front of glove also or instead of the back). Also could be just silicone grip material or the like or some other structural applied material as are commonly applied in appliqué to garments and the like.

Figure 41:
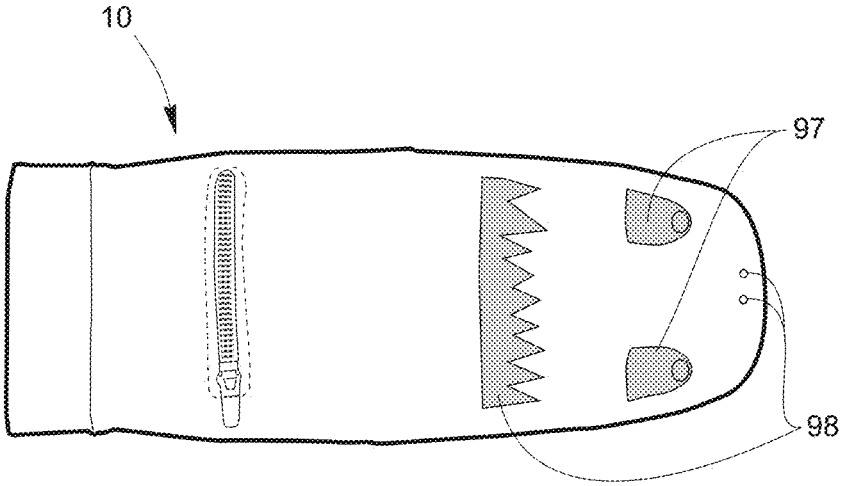
FIG. 41 is a back view of another embodiment of the transformable glove.
Figure 42:
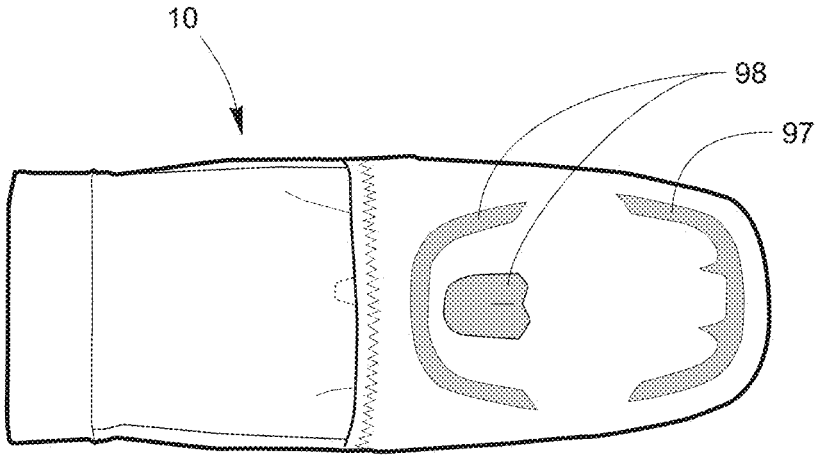
FIG. 42 is a front view of the embodiment of the transformable glove shown in FIG. 41.

FIG. 41 and FIG. 42 show how surface elements 97 can be ornamental (and optionally structural) to provide the desired structure yet also be parts of a character such that glove 10 becomes a puppet glove. Other elements 98, structural or not, can be obviously added to embellish the look of the glove.

Figure 43:
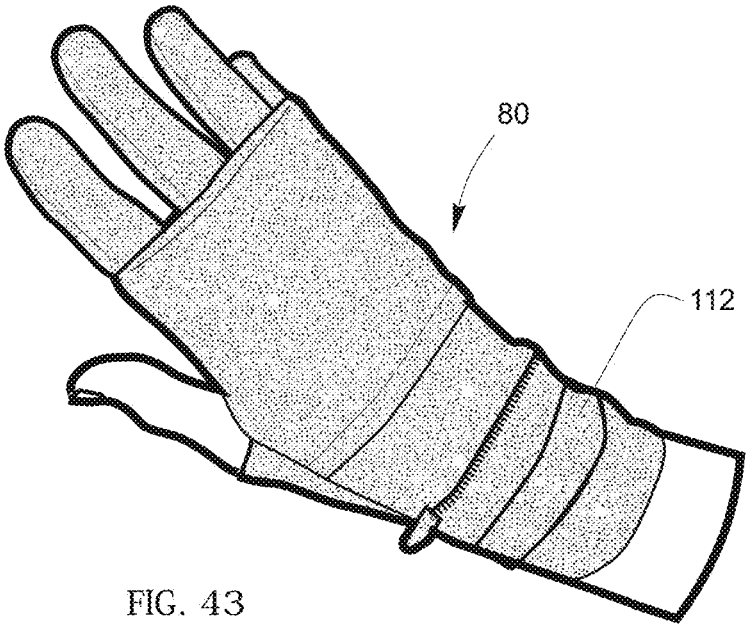
FIG. 43 is a perspective back side view of a user's hand wearing a less preferable embodiment of the transformable glove. The fingers/thumb cover is stowed.
Figure 44:
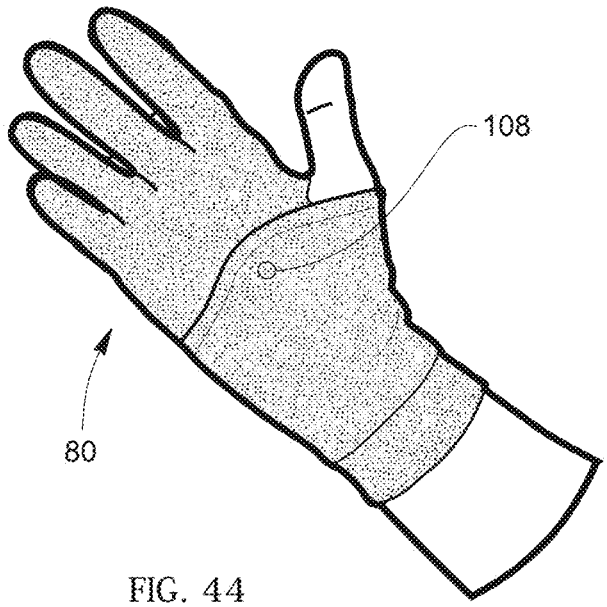
FIG. 44 is a perspective front side view of a user's hand wearing a less preferable embodiment of the transformable glove. The fingers/thumb cover is stowed.

FIG. 43 and FIG. 44 show less preferable embodiment 80 wherein glove fingers are added such that glove 80 has a flap on the back that can be flipped to add extra warmth to finger area. Snap 108 is added such that the palm area can be opened so that a user can have access to fingers and strap 112 is added such that if hand is place through opening created by opening snap, glove can be held out of the way under strap 112.

Figure 45:
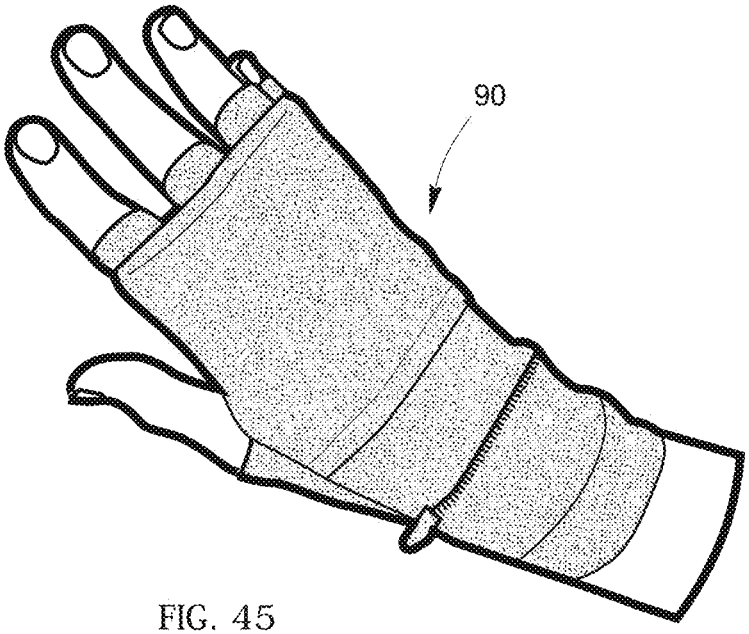
FIG. 45 is a perspective back side view of a user's hand wearing a less preferable embodiment of the transformable glove. The fingers/thumb cover is stowed.
Figure 46:
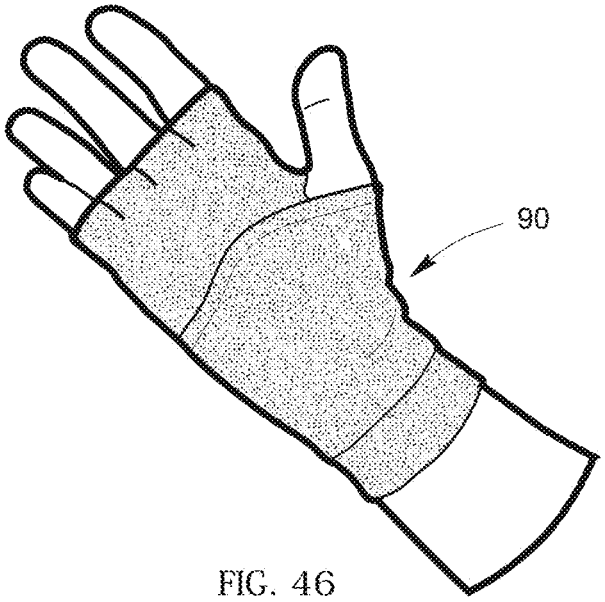
FIG. 46 is a perspective front side view of a user's hand wearing a less preferable embodiment of the transformable glove. The fingers/thumb cover is stowed.

FIG. 45 and FIG. 46 show less preferable glove 90 that is the fingerless version of glove 80. Another less preferable embodiment for a fingerless glove version could be created by sewing short stitch lines through the palm panel to the back panel such that finger slots are created. For this less preferable embodiment preferably 3 somewhat parallel stitch lines would be created such that the resulting confined area would allow the fingers to slide into respective finger slots 111 (see FIG. 61) between the confined back panel and palm panel.

Figure 47:
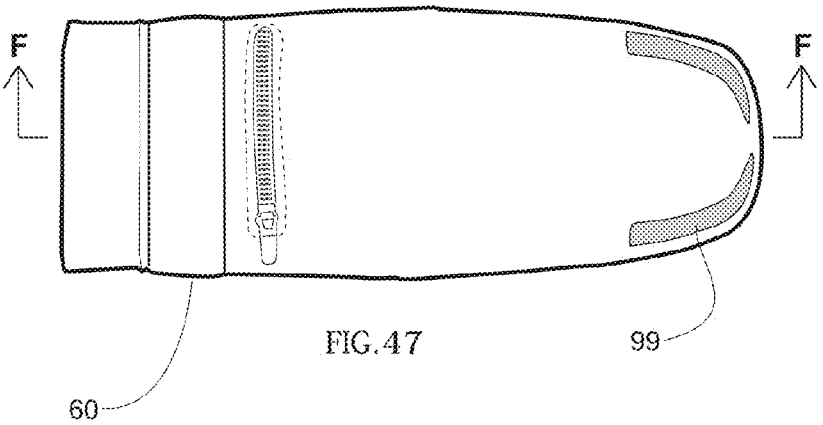
FIG. 47 is a back view of an embodiment of the transformable glove.
Figure 48:
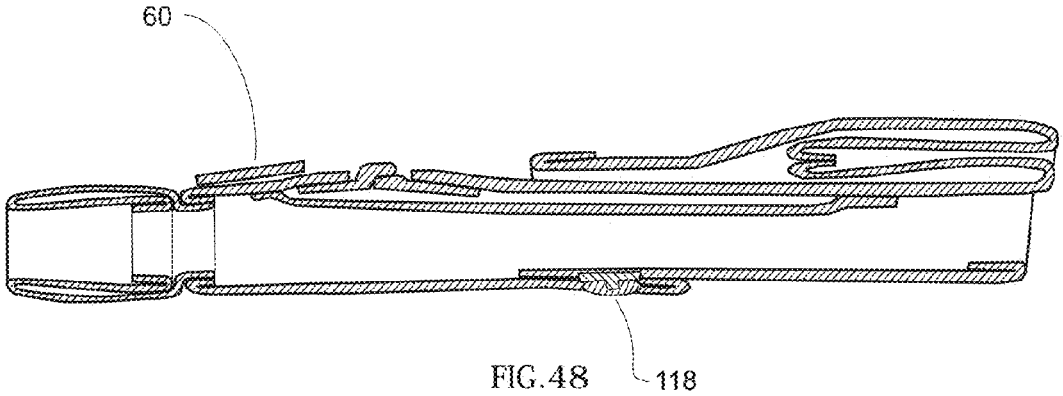
FIG. 48 is a section view (enlarged to show detail) taken through section F-F in FIG. 47.

FIG. 47 and FIG. 48 show another example of a less preferable embodiment that has a strap 60 on the back similar to the strap 112 shown in FIG. 43, as well as the a snap or set of magnets or the like 118 that opens the thumb area completely. The strap can be used to hold the glove back if the whole hand is placed through the unsnapped thumb area. Element 99 is another example shape for a preferable structural element to provide desired structure to fingertip area of glove.

Figure 49:
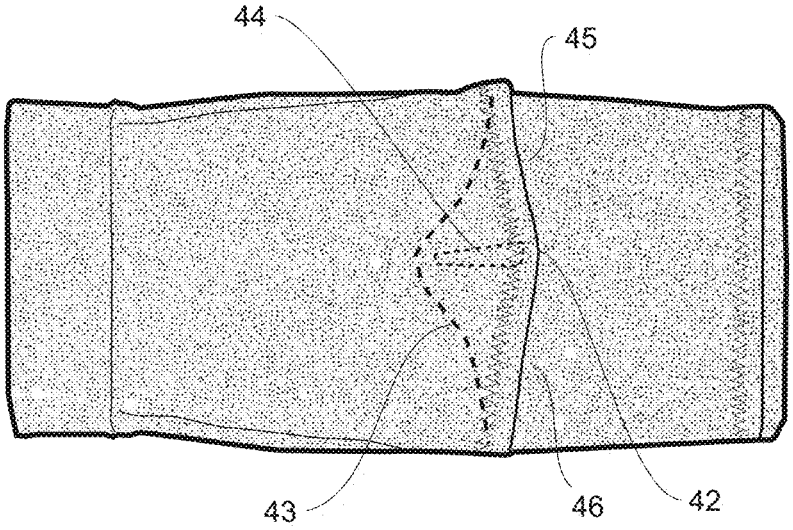
FIG. 49 is a front view of an embodiment of the transformable glove.

FIGS. 49 through 54 show examples of preferable thumb opening area. Some shown in these figures are more preferable that others as is disclosed. FIG. 49 shows a preferable construction for glove 10 with left thumb hole 45, right thumb hole 46 and palm heel panel to palm panel fastening stitch 44. Palm heel panel front edge 42 and hidden (as shown by hidden line) palm panel thumbhole edge 43 are disclosed. FIG. 49 shows thumbhole area construction similar to that disclosed in FIG. 11, though stitch 44 and edge 43 are slightly different and will provide a slightly different fit for a user.

Figure 50:
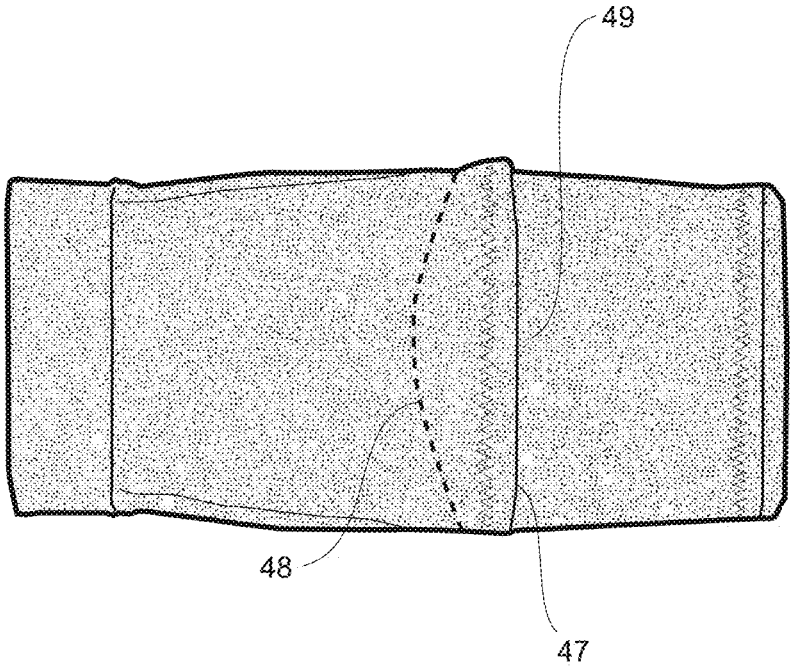
FIG. 50 is a front view of another embodiment of the transformable glove.

FIG. 50 shows a less preferable embodiment wherein the fastening stitch defining left and right thumbholes is eliminated forming a larger single opening 49 that is preferably formed by overlapping palm heel panel edge 47 and palm panel edge 48 shown in hidden line because it is overlapped by palm heel panel edge 47.

Figure 51:
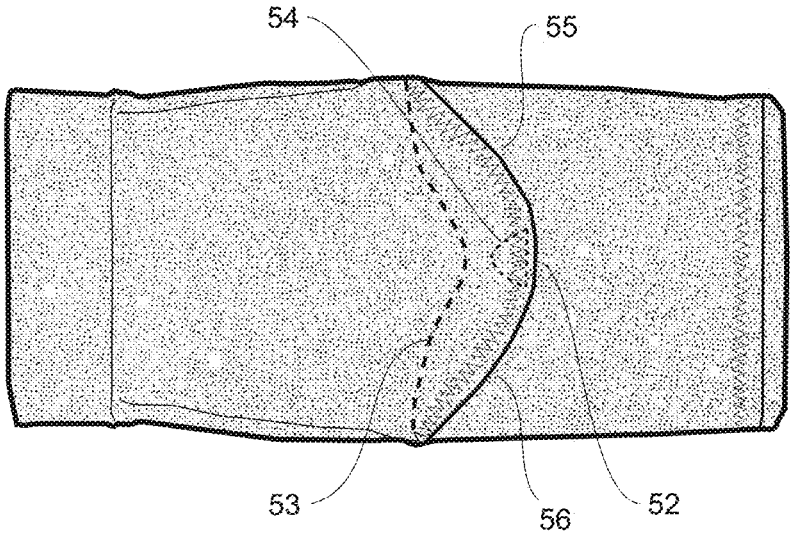
FIG. 51 is a front view of another embodiment of the transformable glove.
Figure 52:
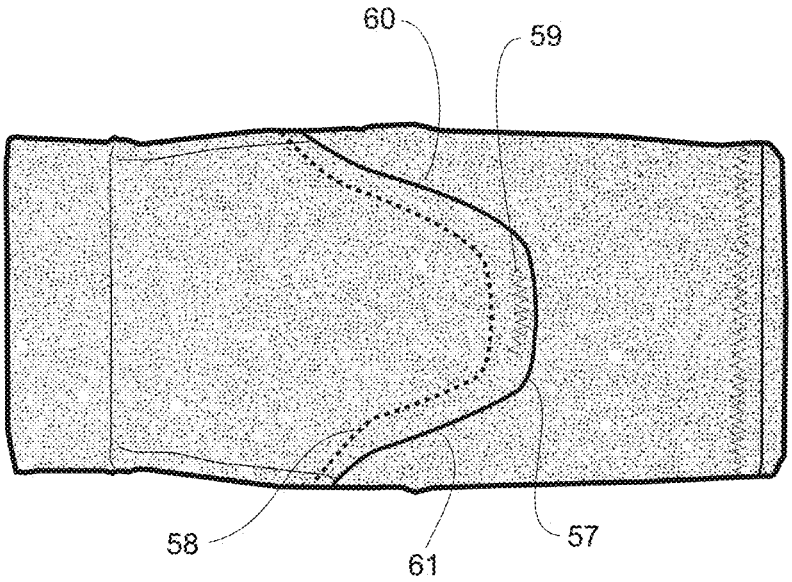
FIG. 52 is a front view of another embodiment of the transformable glove.

FIG. 51 shows another preferable construction for glove 10 with left thumb hole 55, right thumb hole 56 and palm heel panel to palm panel fastening stitch 54. Palm heel panel front edge 52 and hidden palm panel thumbhole edge 53 are disclosed. FIG. 51 shows thumbhole area construction also similar to that disclosed in FIG. 11, though stitch 54, edge 53, and palm heel panel edge 52 are a slightly different shape and will provide a slightly different fit for a user. FIG. 52 shows another preferable construction for glove 10 with left thumb hole 60, right thumb hole 61 and palm heel panel to palm panel fastening stitch 59. Palm heel panel front edge 57 and hidden palm panel thumbhole edge 58 are disclosed.

Figure 53:
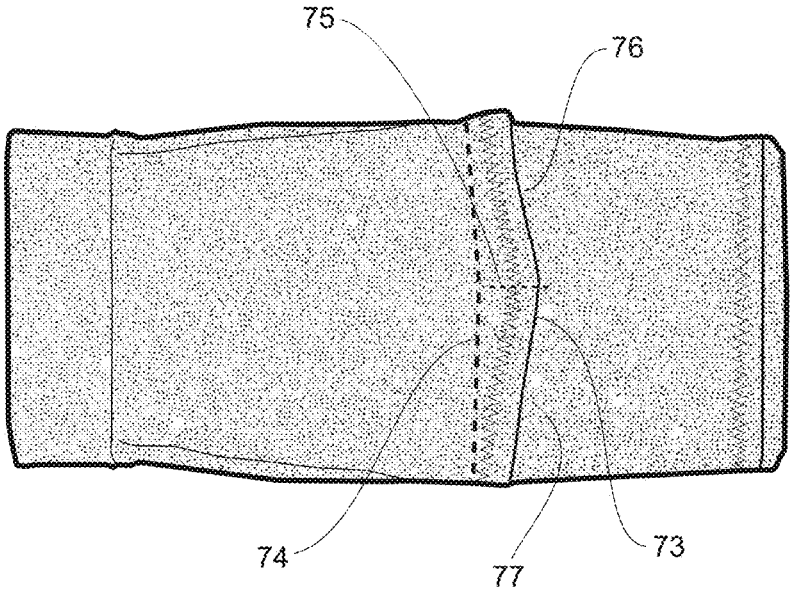
FIG. 53 is a front view of another embodiment of the transformable glove.

FIG. 52 shows thumbhole area construction also similar to that disclosed in FIG. 11, though stitch 59, edge 58, and palm heel panel edge 57 are a slightly different shape and will provide a different fit for a user. FIG. 53 shows another preferable construction for glove 10 with left thumb hole 76, right thumb hole 77 and palm heel panel to palm panel fastening stitch 75. Palm heel panel front edge 73 and hidden palm panel thumbhole edge 74 are disclosed.

Figure 54:
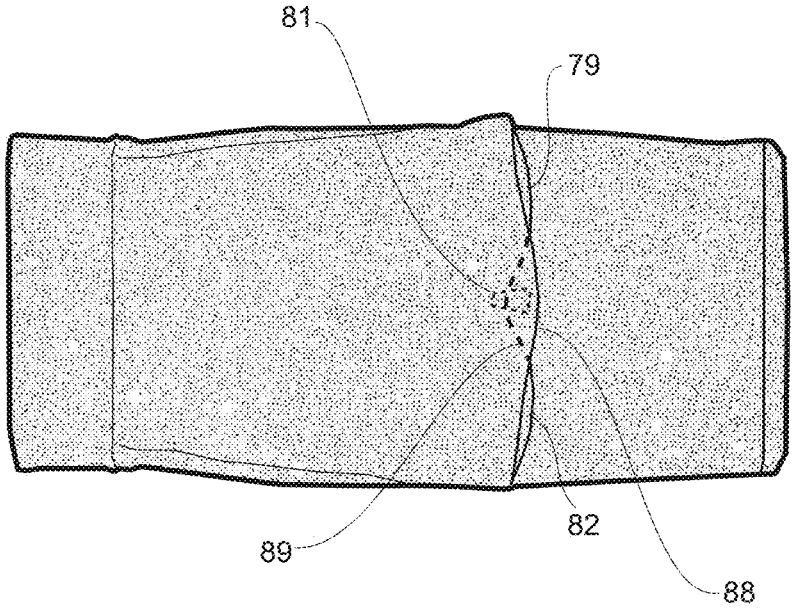
FIG. 54 is a front view of another embodiment of the transformable glove.

FIG. 53 shows thumbhole area construction also similar to that disclosed in FIG. 11, though stitch 75 and edge 74 are a slightly different shape and will provide a slightly different fit for a user. FIG. 54 shows a less preferable embodiment with left thumb hole 79, right thumb hole 82 and palm heel panel to palm panel fastening stitch 81. Palm heel panel front edge 88 and hidden palm panel thumbhole edge 89 are disclosed. FIG. 54 shows a less preferable embodiment of glove wherein overlap between palm panel and palm heel panel is reduced such that there is very little or no overlap such that thumb holes are not covered by much or any of an overlap between these preferable two panels. Generally very little overlap between these two panels is less preferable as it lets in the elements but for some situations and fit considerations it could be a desirable construction (although not for most uses).

Figure 55:
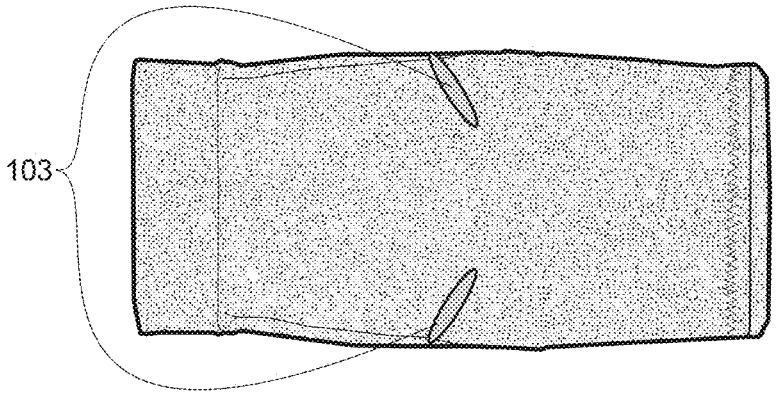
FIG. 55 is a front view of a less preferable embodiment of the transformable glove.

FIG. 55 shows a less preferable embodiment wherein two separate thumb holes slits or the like 103 are disclosed. Slits 103 would be constructed through the palm heel panel and palm panel could be eliminated. Ideally, in such a version, the palm heel panel would extend from the proximal end toward the distal end, terminating at a location where the palm panel terminated in other preferred versions.

Figure 56:
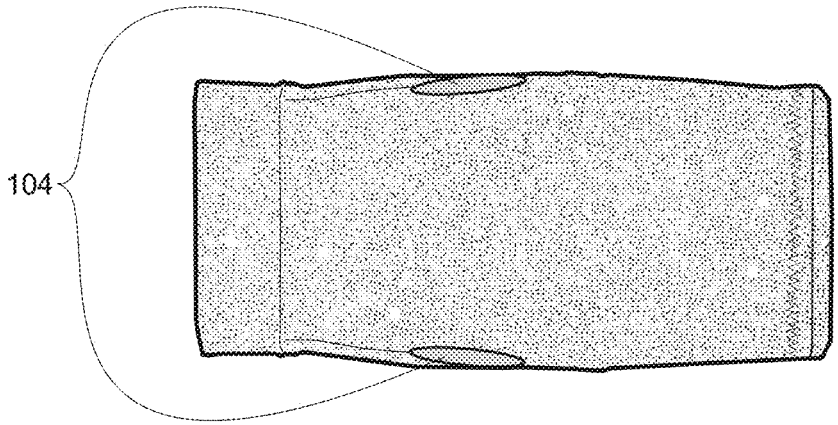
FIG. 56 is a front view of another less preferable embodiment of the transformable glove.

FIG. 56 shows a less preferable embodiment wherein two separate thumb hole slits or the like 104 are disclosed. Slits 104 would be constructed through the palm heel panel and palm panel could be eliminated, also slits 104 could be constructed in (or along) the preferable seam between palm heel panel and back panel such that a thumb hole slit on either side of glove is created such that the glove remains useable by either hand.

Figure 57:
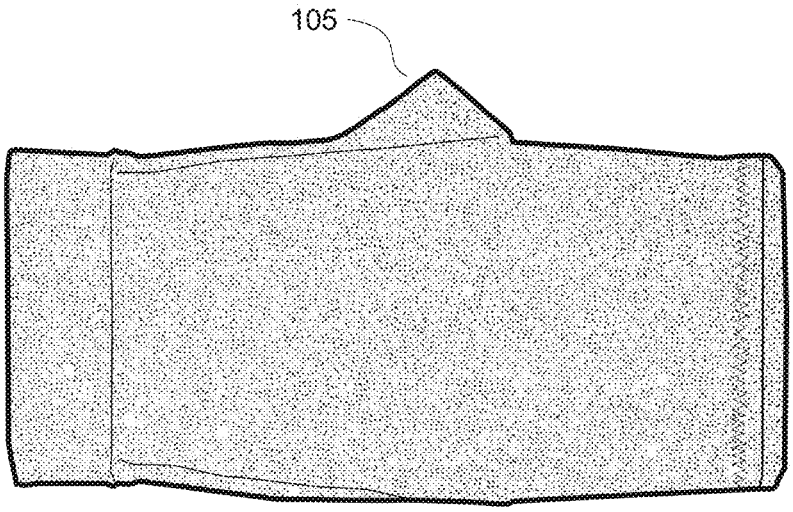
FIG. 57 is a front view of another less preferable embodiment of the transformable glove.

FIG. 57 shows a less preferable embodiment wherein a dedicated thumb hole feature is constructed. As illustrated, the thumb hole feature is configured as a dart 105 extending laterally outward from a slit formed in the glove, with the dart being shaped to surround a base portion of a wrist-facing side of a thumb. The less preferable embodiment shown in FIG. 57 would be dedicated to the left hand (although it could be used on the right hand if desired) and another mirror image of this glove would be produced for the right hand. The back side not shown in FIG. 49 through FIG. 60 would be similar (or the same) in construction as glove 10 previously disclosed.

Figure 58:
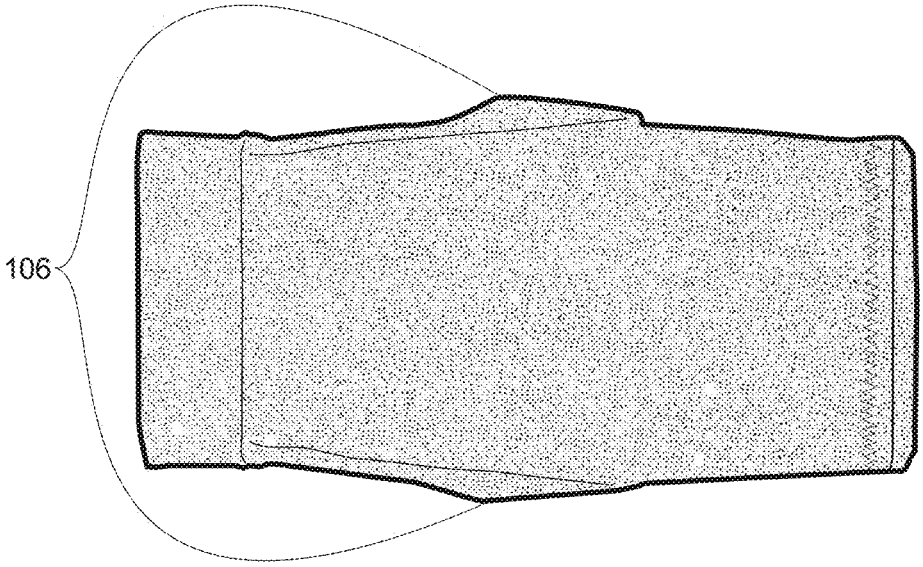
FIG. 58 is a front view of another less preferable embodiment of the transformable glove.

FIG. 58 shows a less preferable embodiment similar to the one shown in FIG. 57, but with two slits, or constructed openings 106, for either thumb are constructed on either side of the glove.

Figure 59:
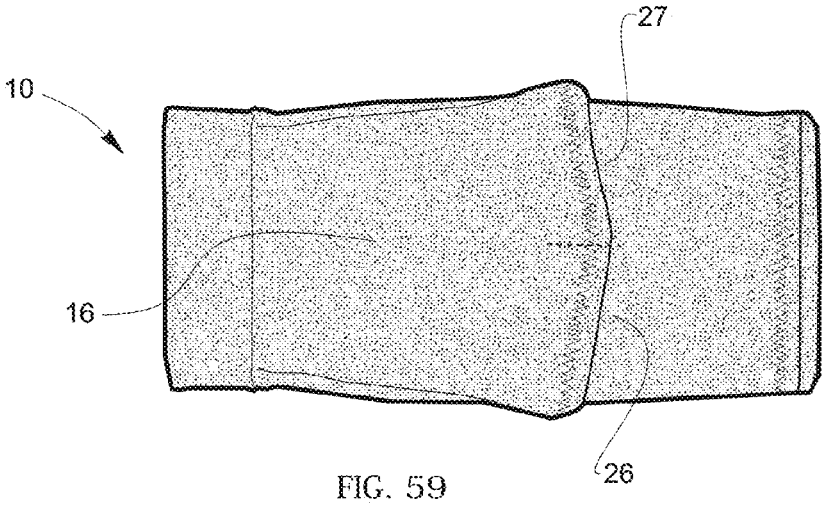
FIG. 59 is a front view of an embodiment of the transformable glove.

FIG. 59 shows a preferable embodiment of glove 10 wherein palm heel panel 16 is shaped such that thumb openings 27 and 26 are more open and larger and when glove 10 is placed on a user's hand the thumb hole not in use would be preferably stretched closed. It can be seen that increasing the size (and or shaping) the palm heel panel 16 toward the thumb hole area creates more slack and would create larger or more shaped openings. In other words, the width of the palm heel panel 16 is greater than that of the back panel 14, thereby creating the slack. Palm heel panel 16 could be shaped in a number of ways including adding darts, sewing in local swatches of material, integrally forming areas such that they are more sculpted to the hand/fingers/thumb in appropriate areas.

Figure 60:
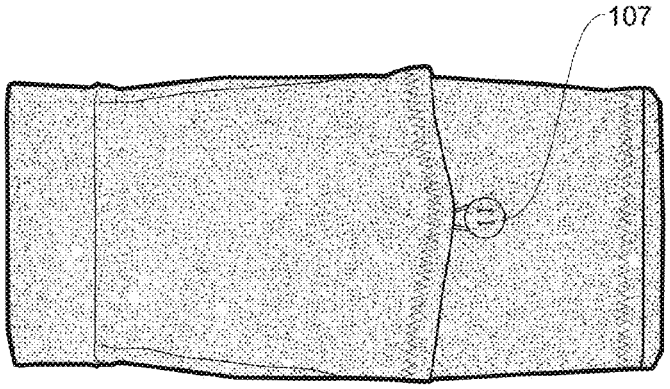
FIG. 60 is a front view of another embodiment of the transformable glove.

FIG. 60 shows a preferable embodiment of glove 10 wherein fastening stitch preferably connecting palm panel to palm heel panel is replaced with a button or other fastener 107 such that a user could selectively open or close this area preferably in the middle. Button or the like element 107 could take the form of a snap, sewn in/integrated magnets, Velcro or other elements for selectively opening closing this area.

FIG. 61 shows less preferable embodiment glove 100 wherein the fingertip portion 101 and palm panel are edge bound 102 such that this area is much similar to a sleeve opening and fingertip portion 101 is biased to stay in this configuration. Optional stitches 111 could be fastened through the palm panel and back panel but preferably not the finger/thumb cover panel to create optional finger slots. One or more confining stitches 111 could be created to form slots such desired fingers are separated. Glove 100 is less preferable for most uses than the preferred embodiment that allows for stowing of fingertip portion although for some uses and for some specific users this configuration may be desirable. As mentioned stitches 111 are optional and could be removed altogether such that one passage for fingers remains and such that whole hand can pass all the way through, such that the glove 100 can be worn on the wrist.

Glove 10 is preferably constructed by sewing somewhat flat die-cut panels of fabric or the like together preferably connected at their periphery thereby forming at least two somewhat parallel planes of somewhat flat panels. Although less preferably it can be constructed by knitting, gluing, integrally forming and/or otherwise fastening parts together that have been manufactured from a variety of processes and techniques. Preferably fabric panels/parts of glove 10, the back panel, cuff, finger/thumb cover panel, palm heel panel, palm panel, pocket panel are die cut from pliable somewhat stretchy fabric like spandex, spandura, stretch denim or the like with one or both sides with a brushed or plush surface such that the resulting glove from the construction of parts is warm, soft, flexible and somewhat stretchy. Preferable panel parts of glove 10 can be made from a variety of materials/fabric in combination to get the desired glove for example the cuff can be constructed from tubular knit material, the palm panel and palm heel panel can be constructed from polar fleece or the like, the back and finger/thumb cover panels can be constructed from brushed stretch denim or the like. Some other optional fabrics for preferable panel parts of glove 10 include: neoprene, rubber, leather, felt, waterproof/water resistant fabric and/or breathable fabric or the like. Panel parts can be constructed from a number fabrics of different materials with varying degrees of success. The invention, with varying degrees of success could be constructed in a variety of different ways other than the preferable cut and sewn or otherwise fastened together manner. For example various parts of the invention could be combined, molded as one, woven, heat sealed together, ultrasonically bonded together or formed in other ways.

The preferable fastening stitch between the palm heel panel and palm panel could be replaced with another type of fastener, integrally formed, woven in place or produced in a variety of other methods (although in most cases the disclosed stitch method is preferable). The preferable fastening stitch could be replaced with many different kinds of snaps, loop systems, magnets, hook/loops and other fasteners, incorporated in other arrangements with varying degrees of success.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A transformable glove, comprising:

a back panel having a length from a proximal end to a distal end, the length being greater than a width of the back panel, the back panel having a left side edge and a right side edge; a palm heel panel having a left side, a right side, a distal end, and a proximal end, the palm heel panel overlying the back panel;

a palm panel having a left side, a right side, a distal end, and a proximal end, the palm panel overlying the back panel, the distal end of the palm heel panel being positioned adjacent the proximal end of the palm panel; the left side of the palm heel panel and the left side of the palm panel each being attached to the left side edge of the back panel along a left seam, the right side of the palm heel panel and the right side of the palm panel each being attached to the right side edge of the back panel along a right seam, wherein the proximal end of the palm heel panel and the proximal end of the back panel combine to form an opening to receive a hand of a user;

a thumb opening positioned between the proximal end of the palm heel panel and the distal end of the palm panel, the thumb opening further being located adjacent the left seam and being configured to receive the thumb of a user when wearing the transformable glove; and a finger panel having a left side, a right side, a distal end, and a proximal end, the left side of the finger panel being attached to the left side of the back panel along the left seam, the right side of the finger panel being attached to the right side of the back panel along the right seam, and the distal end of the finger panel being attached to the distal end of the back panel, whereby the finger panel and a portion of the back panel cooperate to form an invertible finger pocket.

2. The transformable glove of claim 1, wherein the palm panel and the palm heel panel are integrally formed.

3. The transformable glove of claim 2, wherein the left side of the finger panel is sandwiched between the palm panel and the back panel at the left seam and the right side of the finger panel is sandwiched between the palm panel and the back panel at the right seam.

4. The transformable glove of claim 2, further comprising an additional thumb opening positioned adjacent the right seam and being configured to receive the thumb of a user when wearing the transformable glove.

5. The transformable glove of claim 2, further comprising a stiffener attached to the finger pocket, the stiffener being configured to retain the finger pocket in an inverted stowed position.

6. The transformable glove of claim 5, wherein the stiffener comprises a layer of reflective material.

7. The transformable glove of claim 5, wherein the stiffener comprises an applied film.

8. The transformable glove of claim 5, wherein the stiffener comprises a layer of applied material.

9. The transformable glove of claim 5, wherein the stiffener is positioned on the distal end of the back panel.

10. The transformable glove of claim 5, wherein the stiffener is positioned on the distal end of the finger panel.

11. The transformable glove of claim 6, wherein the stiffener is positioned on the back panel adjacent the distal end.

12. The transformable glove of claim 1, further comprising a means for biasing a nose portion of the finger pocket in an inverted stowed position.

13. The transformable glove of claim 1, wherein the palm panel and the palm heel panel are formed as separate panels and joined together at an interface of the proximal end of the palm panel and the distal end of the palm heel panel.

14. The transformable glove of claim 1, wherein the left side of the finger panel is sandwiched between the palm panel and the back panel at the left seam and the right side of the finger panel is sandwiched between the palm panel and the back panel at the right seam.

15. The transformable glove of claim 1, further comprising an additional thumb opening positioned between the proximal end of the palm heel panel and the distal end of the palm panel, the additional thumb opening being located adjacent the right seam and being configured to receive the thumb of a user when wearing the transformable glove.

16. A transformable glove, comprising:

a back panel having a length from a proximal end to a distal end, the length being greater than a width of the back panel, the back panel having a left side edge and a right side edge; a palm heel panel having a left side, a right side, a distal end, and a proximal end, the palm heel panel overlying the back panel;

a palm panel having a left side, a right side, a distal end, and a proximal end, the palm panel overlying the back panel, the distal end of the palm heel panel being positioned adjacent the proximal end of the palm panel; the left side of the palm heel panel and the left side of the palm panel each being attached to the left side edge of the back panel along a left seam, the right side of the palm heel panel and the right side of the palm panel each being attached to the right side edge of the back panel along a right seam, wherein the proximal end of the palm heel panel and the proximal end of the back panel combine to form an opening to receive a hand of a user;

a finger panel having a left side, a right side, a distal end, and a proximal end, the left side of the finger panel being attached to the left side of the back panel along the left seam, the right side of the finger panel being attached to the right side of the back panel along the right seam, and the distal end of the finger panel being attached to the distal end of the back panel, whereby the finger panel and a portion of the back panel cooperate to form an invertible finger pocket; and a stiffener attached to the finger pocket, the stiffener being configured to retain the finger pocket in an inverted stowed position.

17. The transformable glove of claim 16, wherein the palm panel and the palm heel panel are integrally formed.

18. The transformable glove of claim 16, wherein the left side of the finger panel is sandwiched between the palm panel and the back panel at the left seam and the right side of the finger panel is sandwiched between the palm panel and the back panel at the right seam.

19. The transformable glove of claim 16, further comprising an opening positioned adjacent the left seam and being configured to receive the thumb of a user when wearing the transformable glove.

20. The transformable glove of claim 19, further comprising an opening positioned adjacent the left seam and being configured to receive the thumb of a user when wearing the transformable glove.

21. A transformable glove, comprising:

a back panel having a length from a proximal end to a distal end, the length being greater than a width of the back panel, the back panel having a left side edge and a right side edge;

a palm heel panel having a left side, a right side, a distal end, and a proximal end, the palm heel panel overlying the back panel;

a palm panel having a left side, a right side, a distal end, and a proximal end, the palm panel overlying the back panel, the distal end of the palm heel panel being positioned adjacent the proximal end of the palm panel; the left side of the palm heel panel and the left side of the palm panel each being attached to the left side edge of the back panel, the right side of the palm heel panel and the right side of the palm panel each being attached to the right side edge of the back panel, wherein the proximal end of the palm heel panel and the proximal end of the back panel combine to form an opening to receive a hand of a user;

a finger panel having a left side, a right side, a distal end, and a proximal end, the left side of the finger panel being attached to the left side of the back panel, the right side of the finger panel being attached to the right side of the back panel, and the distal end of the finger panel being attached to the distal end of the back panel, whereby the finger panel and a portion of the back panel cooperate to form an invertible finger pocket; and a stiffener attached to the finger pocket, the stiffener being configured to retain the finger pocket in an inverted stowed position.

22. The transformable glove of claim 21, wherein the palm panel and the palm heel panel are integrally formed.

23. The transformable glove of claim 21, wherein the stiffener comprises a layer of reflective material.

24. The transformable glove of claim 21, wherein the stiffener is positioned on the back panel adjacent the distal end.

25. The transformable glove of claim 22, wherein the stiffener comprises a layer of applied material.

* * * * *